US006929357B2

(12) United States Patent
Qingguo et al.

(10) Patent No.: US 6,929,357 B2
(45) **Date of Patent: *Aug. 16, 2005**

(54) INK CARTRIDGE HAVING BELLOWS VALVE, INK FILLING METHOD AND APPARATUS USED THEREOF

(75) Inventors: Xiao Qingguo, Zhuhai (CN); Li Yu, Zhuhai (CN)

(73) Assignee: Unicorn Image Products Co. Ltd., Zhuhai (CN)

( * ) Notice: Subject to any disclaimer, the term of this patent is extended or adjusted under 35 U.S.C. 154(b) by 54 days.

This patent is subject to a terminal disclaimer.

(21) Appl. No.: 10/373,330

(22) Filed: Feb. 24, 2003

(65) Prior Publication Data

US 2003/0128257 A1 Jul. 10, 2003

Related U.S. Application Data

(63) Continuation of application No. 09/930,517, filed on Aug. 15, 2001, now abandoned.
(60) Provisional application No. 60/225,722, filed on Aug. 16, 2000.

(30) Foreign Application Priority Data

Oct. 12, 2000 (CN) ..... 00131642 A
Nov. 18, 2000 (CN) ..... 00133063 A
Feb. 27, 2001 (CN) ..... 01107578 A

(51) Int. Cl.[7] ..... B41J 2/175
(52) U.S. Cl. ..... 347/85
(58) Field of Search ..... 347/85, 86, 87; 137/454.2; 277/377, 387, 389

(56) References Cited

U.S. PATENT DOCUMENTS 4,053,902 A 10/1977 Skafvenstedt et al.
4,383,263 A 5/1983 Ozawa et al.
4,422,084 A 12/1983 Saito
4,463,362 A 7/1984 Thomas
4,509,062 A 4/1985 Low et al.
4,677,447 A 6/1987 Nielsen
4,700,202 A 10/1987 Kuranishi et al.
4,791,438 A 12/1988 Hanson et al.
4,994,824 A 2/1991 Winslow
5,085,355 A 2/1992 Yoshimura et al.
5,233,369 A 8/1993 Carlotta et al.
5,270,739 A 12/1993 Kitani et al.
5,280,299 A 1/1994 Saikawa et al.
5,365,260 A 11/1994 Kitani et al.
5,453,772 A 9/1995 Aono et al.

(Continued)

FOREIGN PATENT DOCUMENTS

CN 1133784 A 10/1996
CN 1185379 A 6/1998
EP 1016533 A1 * 7/2000 ..... B41J/2/175

*Primary Examiner*—Anh T. N. Vo
(74) *Attorney, Agent, or Firm*—Fay, Sharpe, Fagan, Minnich & McKee, LLP

(57) ABSTRACT

An ink cartridge, ink filling method and apparatus are disclosed. A one valve is disposed in the ink chamber of an ink cartridge and includes a foot support portion, a wall support portion projecting at an angle from the interior side of foot support portion, a shoulder support portion bending towards the interior side of wall support portion, and a head support portion projecting from shoulder support portion with a through hole. A valve sealing assembly being maintained selectively in contact with the head support portion through hole by a pressure difference. A sealing assembly integrally formed with a block portion is disposed at ink outlet port. The cartridge is very sensitive to pressure changes, which enhances printing quality. At the same time, the sealing assembly of the cartridge has an enhanced sealing function in non-usage status and usage status as well.

31 Claims, 24 Drawing Sheets

U.S. PATENT DOCUMENTS

| | | | |
|---|---|---|---|
| 5,477,963 | A | 12/1995 | Mochizuki et al. |
| 5,479,198 | A | 12/1995 | Kawano et al. |
| 5,488,401 | A | 1/1996 | Mochizuki et al. |
| 5,500,665 | A | 3/1996 | Ujita et al. |
| 5,504,511 | A | 4/1996 | Nakajima et al. |
| 5,576,749 | A | 11/1996 | Mochizuki et al. |
| 5,606,988 | A | 3/1997 | Pawlowski, Jr. |
| 5,608,437 | A | 3/1997 | Iwata et al. |
| 5,633,667 | A | 5/1997 | Miyazawa |
| 5,719,609 | A | 2/1998 | Hauk et al. |
| 5,777,647 | A | 7/1998 | Pawlowski, Jr. et al. |
| 5,790,158 | A | 8/1998 | Shinada et al. |
| 5,812,155 | A | 9/1998 | Seccombe |
| 5,838,352 | A | 11/1998 | Martinez |
| 5,847,735 | A | 12/1998 | Betschon |
| 5,889,543 | A | 3/1999 | Miyazawa et al. |
| 5,949,458 | A | 9/1999 | Studholme |
| 6,000,788 | A | 12/1999 | Iida |
| 6,039,441 | A | 3/2000 | Tomikawa et al. |
| 6,045,207 | A | 4/2000 | Mochizuki et al. |
| 6,145,974 | A | 11/2000 | Shinada et al. |
| 6,170,939 | B1 | 1/2001 | Ujita et al. |
| 6,247,803 | B1 | 6/2001 | Kanaya et al. |
| 6,257,711 | B1 | 7/2001 | Higuma et al. |

* cited by examiner

INK CARTRIDGE HAVING BELLOWS VALVE, INK FILLING METHOD AND APPARATUS USED THEREOF

CROSS REFERENCE TO RELATED APPLICATION

This application is a continuation application of U.S. Ser. No. 09/930,517, filed Aug. 15, 2001 abandoned of Xiao Qingguo, et al., which claims the benefit of Provisional Application No. 60/225,722 filed, Aug. 16, 2000, herein incorporated by reference.

FIELD OF THE INVENTION

This invention relates to an ink cartridge for storing liquid ink for use with an ink jet head or printer head and supplying ink thereto. More particularly, the present invention relates to a cartridge having a one-way valve for controlling ink supply to the print head. The cartridge also involves a sealing assembly integrally formed with a sealing portion and a block portion.

This invention still relates to an ink filling method and apparatus for the ink cartridge, which employs a one-way valve to control the ink flow and especially either using positive or negative pressure difference to fill the cartridge.

BACKGROUD OF THE INVENTION

Conventionally, in an ink jet printer, it is desirable to keep the interior of the ink tank under a suitable negative pressure. Chinese Patent Publication No. 1185379A discloses a device (FIG. 1) used to keep an ink tank in a negative pressure condition. An ink tank 10 is filled with ink 14 and a porous body 12, such as a foam, absorbs the ink. The mechanics of surface energy play a role in retaining ink in the interstices or cells of the foam. Volumetric efficiency, however, in using foam is only about 60–65%. Therefore, these designs are deemed to be less efficient than desired.

U.S. Pat. No. 4,677,447—Nielsen teaches use of a check valve 22 and an ink tank 20 to control ink flow as shown in FIG. 2. An elastic umbrella-shaped diaphragm 22 selectively seals about an opening 25. In operation, negative pressure acts on the diaphragm valve to allow ink 24 to flow from the reservoir into a small cavity adjacent nozzles of a thermal ink jet print head. The check valve of this structure, however, is not capable of preventing air bubbles. The air bubbles become trapped within the cavity 26, and expand and contract in response to pressure or temperature changes and preclude ink from leaving the cavity. Ink leakage can occur through the nozzles of the print head by an expanding and contracting air bubble forcing ink from the small cavity and through the nozzles.

For example, Chinese Patent Publication CN1133784A discloses a funnel-shaped packing member 100 being formed with a through hole as shown in FIG. 3A. The packing member is also provided with a tapered surface 102 engaging with the needle 104 for providing ink to an associated printing mechanism. It is necessary to add an additional sealing film 106 in the ink supply port in order to prevent ink from leaking, thus the cost would increase.

U.S. Pat. No 5,790,158 discloses an ink cartridge, which also possesses a sealing "O" ring 120 with a hole as shown FIG. 3B. This kind of sealing structure plays a good role in sealing but it is also necessary to add a sealing film 124 outside the chamber 122 for purposes of shipping.

U.S. Pat. No. 5,949,458 discloses a sealing member 130 as shown in FIG. 3C. The sealing member 130 is integrally formed with a pierceable sealing septum 132. In application the septum is sometimes not be easily pierced through, as the septum 132 possesses high tenacity.

Obviously, the above mentioned sealing structures need a seal film welded in the outside surface of the ink cartridge to prevent ink leakage upon the insertion of ink supply needle and there still needs a sealed package during shipping and when the cartridge is out of use.

It is known how to produce an ink cartridge in mass production and fill ink in the cartridges efficiently in order to increase productivity.

U.S. Pat. No 5,280,299 discloses an ink cartridge employing a porous material shown in FIG. 4 and method of filling ink as shown in FIG. 5. The porous material 14 is located in the tank and the tank attached to a print head. The process of filling ink in the ink cartridge is shown in FIG. 5. That is, at step 1(p1), the process includes the step of providing an empty ink cartridge; at step2 (p2), putting porous material into the tank; at step 3 (p3), sealing the entrance for the porous material of the tank; at step 4 (p4), checking for leakage; at step 5 (p5), reducing the pressure; at step 6 (p6), filling the ink; at step 7 (p7), removing the residual free ink; and at step 8 (p8), sealing the outlet of the liquid ink.

The above mentioned method is difficult to operate. There is some space or gap between the porous material and the inside of ink cartridge that stores some liquid ink called "free ink". "Free ink" could ultimately leak from the cartridge and removing the residual is needed. But the "free ink" may not be located or reserved at the same place and the location of the "free ink" is different according to the different ink cartridges. Especially "free ink" is not always located near the entrance of the liquid ink but appears far away in remote regions of the cartridge. In that case, it is difficult to remove the "free ink", and it is possible that the liquid ink stored in the porous materials to be removed as "free ink", may lead to the change of the total input of ink as well as the ink distribution in the porous materials.

It should be pointed out that the operation of removing the "free ink" is occurring at the print head. The liquid ink is filled near the ink print head and the "free ink" from other areas of the cartridge could be withdrawn together with the stored ink and lead to starvation of liquid ink in operation.

As mentioned above, it is difficult for the process to fill ink into porous materials of the ink cartridge and it is difficult to remove the "free ink". As the porous material occupies some space of the ink cartridge, there is some ink remained in the porous materials after printing, which limits the amount of liquid ink which should be provided by the ink cartridge and increases the cost.

Accordingly, an improved ink cartridge and filling method and apparatus that address these problems and others would be desirable.

SUMMARY OF THE INVENTION

An exemplary embodiment of the invention is an ink cartridge of simple structure, which is easy to handle, easily manufactured, of high mechanical strength, does not mix air with the liquid ink supplied from the cartridge, and prevents ink from leaking from the cartridge.

The present invention provides an ink cartridge, which employs a one-way valve operatively associated with ink supply port for controlling ink flow. The present invention provides a one-way valve, which is step-shape designed in order to be deformed easily.

The present invention provides a cartridge in which an outlet is sealed though a sealing assembly integrally formed with a sealing portion and a block portion. This device functions well in sealing the cartridge both during transport and in operation upon the insertion of the printer needle.

The present invention provides a method of filling liquid ink into an ink cartridge by means of a one-way valve under negative pressure. The present invention provides a device for filling the ink into the cartridge in which the needle is used to withdraw the air to form a negative pressure and fill ink to a predetermined level.

The present invention provides a method of filling the ink cartridge employing a one-way valve to store and control the liquid ink, directly by positive pressure under normal temperature.

An ink cartridge for an ink jet recording apparatus, comprises: a cartridge body for accommodating ink provided with at least one ink chamber, wherein the cartridge body comprising at least an air vent for providing fluid communication between the ink chamber and outside air;

at least an ink outlet port for supplying the ink from the ink chamber; and at least a sealing member provided within the ink outlet port;

at least a one-way valve disposed within the ink chamber for controlling ink flow, wherein at least one-way valve is integrally provided with a foot support portion sealing an interior wall of the ink outlet port;

a wall support portion projecting from the interior of the foot support portion;

a shoulder support portion bending toward an interior of the wall support portion;

a head support portion projecting from the shoulder support portion formed with a through hole; and a valve sealing assembly for blocking the through hole of the head support portion.

According to the ink cartridge, the wall support portion projects at an angle from the foot support portion.

According to the ink cartridge, the shoulder support portion is provided with a recess formed by the wall support portion bending inwardly.

According to the ink cartridge, the head support portion projects at an angle from the shoulder support portion.

According to the ink cartridge, the head support portion is cone-shaped.

According to the ink cartridge, the sloping angle of the head support portion is dimensioned to be greater than that of the wall support portion.

According to the ink cartridge, the thickness of the foot support portion is dimensioned to be greater than that of the head support portion and the thickness of the head support portion is dimensioned to be greater than that of the shoulder support portion.

According to the ink cartridge, a recess is formed by an interior wall of the ink outlet port for receipt of the valve.

According to the ink cartridge, the recess further includes a stepped circular region defined by the bottom wall of the recess for receipt of a filter member.

According to the ink cartridge, the head support portion of the one-way valve is in a slightly compressed state with the valve sealing assembly.

According to the ink cartridge, an ink leakage preventing device is disposed at the air vent to prevent ink leaking from the air vent.

According to the ink cartridge, an ink leakage preventing device is a protrusion extending outwardly from the air vent to the ink chamber.

According to the ink cartridge, the ink leakage preventing device is a bending tube surrounding the periphery of the air vent, with one end connecting to the air vent and the other end coming out of the ink.

According to the ink cartridge, the ink leakage preventing device is a bag-shaped member disposed within the ink chamber comprising an open end, for connecting to the air vent; and a tiny hole, provided in a wall of the bag-shaped member.

According to the ink cartridge, the bag-shaped member is an elastic balloon.

According to the ink cartridge, a bowl-shaped cap for fixing the elastic balloon comprises an opening therethrough, the opening having a wide end dimensioned to engage with the out periphery of the protrusion of the air vent and a narrow end acting as an elongated part of the air vent; and a shoulder on which the open end of the elastic balloon is mounted.

According to the ink cartridge, the bottom wall of the ink chamber leans or slopes to the ink outlet port.

According to the ink cartridge, at least an ink guide groove is formed in the surface of the bottom wall of the ink chamber.

According to the ink cartridge, a projection is provided on the bottom wall of the ink chamber to prevent the bag-shaped member from blocking the opening of the valve sealing member.

According to the ink cartridge, the open end of the bag-shaped member has an opening substantially equal to the wall of cartridge body on which the air vent is provided within.

According to the ink cartridge, the bag-shaped member has several overlapped layers.

According to the ink cartridge, the air vent communicates with the outside or atmosphere via the irregular air-guided vent formed in the wall of the cartridge body.

According to the ink cartridge, part of the air-guided vent is disposed at the interior surface of the wall.

According to the ink cartridge, an air guide film is provided on the outside surface of the wall on which the air vent is provided.

According to the ink cartridge, an ink filling hole is provided on a wall of the cartridge body and is sealed by a seal plug.

According to the ink cartridge, the sealing assembly provided within the ink outlet comprises a support portion integrally formed with a chamber inside, supported by the interior wall of the ink outlet port;

a sealing portion projected from the support portion;

a block portion connected to the sealing portion; and a connection portion surrounding between the sealing portion and the block portion to support the block portion being separated from the connection portion upon a certain pressure.

According to the ink cartridge, a tapered surface is provided inwardly of the sealing assembly.

According to the ink cartridge, a circle-shaped groove is provided for placing the support portion of the sealing assembly to facilitate separation of the block portion from the sealing assembly.

According to the ink cartridge, the thickness of the connection portion is different.

According to the ink cartridge, the thickness of the connection portion decreases from one side to the other.

According to the ink cartridge, an off-gas vent is provided on the wall of the ink outlet port.

A one-way valve for controlling the ink flow comprises a foot support portion;

a wall support portion projecting from the interior of foot support portion;

a shoulder support portion bending toward interior of the wall support portion; and a head support portion projecting from the shoulder support portion formed with a through hole.

According to the one-way valve, the shoulder support portion is provided with a recess formed by the wall support portion bending inwardly.

According to the one-way valve, the head support portion projects at an angle from the shoulder support portion.

According to the one-way valve, the thickness of the foot support portion is dimensioned to be greater than that of the head support portion and the thickness of the head support portion is dimensioned to be greater than that of the shoulder support portion.

An ink filling method for filling an ink cartridge, comprises the steps of:

a) sealing the ink cartridge;

b) forming a negative pressure in the cavity by drawing the air in both the ink guide cavity and ink chamber;

c) filling a pre-defined amount of ink into the ink cartridge.

According to the ink filling method, the step b) comprises the steps of d) penetrating an off-gas vent on a wall of the ink guide cavity formed by the one-way valve and the sealing assembly;

e) inserting a drawing needle at the off-gas vent.

According to the ink filling method, the method further comprises the steps of f) pulling out the drawing needle from the off-gas vent when the air pressure reaches the pre-defined value, An ink filling apparatus for filling the ink cartridge, the ink cartridge comprising:

an air vent for providing fluid communication between the ink chamber and outside air;

an ink supply port for supplying ink from the ink chamber;

a sealing assembly disposed at an ink outlet port to seal ink therein;

a one-way valve coupled with a valve sealing assembly blocking its through hole of a head support portion, disposed at the bottom of the ink tank and forming an ink guide cavity together with sealing assembly for holding and controlling ink; and an ink filling apparatus comprising:

a compressed apparatus, used for sealing the cover of said ink cartridge;

an ink supply container;

an ink filling needle, which inserts into said ink cartridge, connects to said ink supply container via a tube;

a flow control device for controlling ink flow from said ink supply container to said ink cartridge;

an air pump;

an absorbing needle which connects to said air pump by one side and penetrating the off-gas vent of said ink cartridge by another side at least one valves is disposed separately at the tubes between said flow control device and said ink supply container, and between said flow control device and said ink filling needle.

An ink filling method for filling the ink cartridge, comprising:

putting the ink cartridge in a closed chamber;

forming a negative pressure in the closed chamber, filling a pre-defined amount of ink in said ink cartridge.

An ink filling method according to claim 40, further comprising:

pulling out air from the lower part of the one-way valve;

inserting the sealing assembly within the ink supply port of said ink cartridge.

a) the flow control device and the ink filling b) by the negative

In accordance with one aspect of the present invention, the air bubble will be prevented as there is a small cavity between the valve and the bottom wall and a reserving liquid in the small cavity.

In accordance with another aspect of the present invention, the air bubble will be prevented as the ink cavity or ink guide chamber is configured small enough, and the air trapped in the ink guide chamber can be drawn out by the cleaning action of the printer operation.

In accordance with another aspect of the present invention, the liquid ink will fill the small cavity from the tank to support printing as the one-way valve operates in response to very small pressure changes, the valve may be used in a wider range of pressures and adapt well thereto. It is important that the ink be fully used and the cost of making the ink cartridge is reduced, the process of filling is simple and operation control is increased.

In accordance with another aspect of the present invention, an ink cartridge of the present invention can prevent ink leakage.

In accordance with another aspect of the present invention, an ink cartridge of the present invention guarantees the seal part both to withstand a certain degree of force and to engage with the needle upon the insertion of the ink supply needle.

In accordance with further aspect of the present invention, the operation of sealing assembly is easy and the cost is low as the sealing part is designed by integration of the supporting portion, sealing portion, block portion and connection portion.

BRIEF DESCRIPTION OF THE DRAWINGS

The present invention will be obvious by description combined with the following drawings and the preferred embodiments.

DETAILED DESCRIPTION OF THE PREFERRED EMBODIMENTS

Figure 7A:
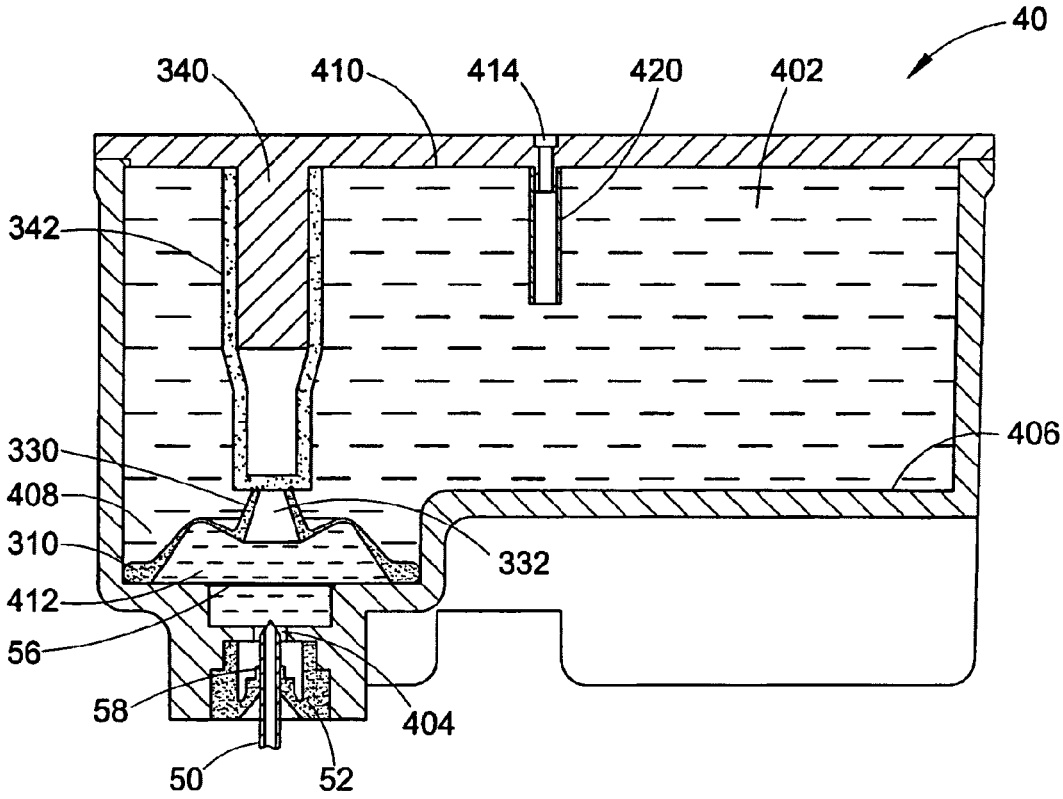
FIG. 7A is a sectional view of an ink cartridge according to a first embodiment of the present invention.

FIG. 7A is a first preferred embodiment of the invention. The valve 30 selectively blocks its opening 332 to separate ink in the ink chamber 402 from ink discharge port 404.

Figure 1:
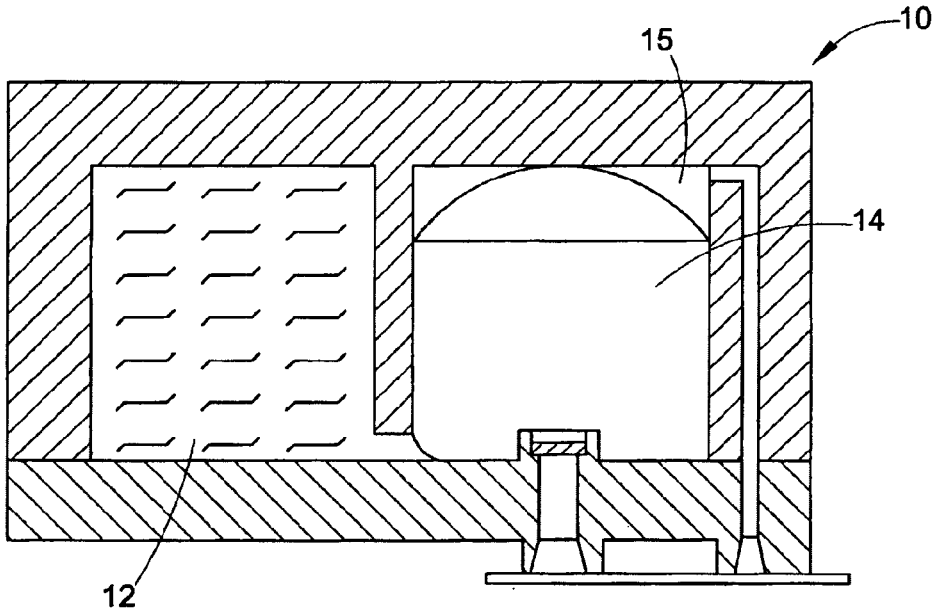
FIG. 1 ( PRIOR ART )
FIG. 1 shows a prior art ink cartridge which employs a foam in the cartridge.
Figure 2:
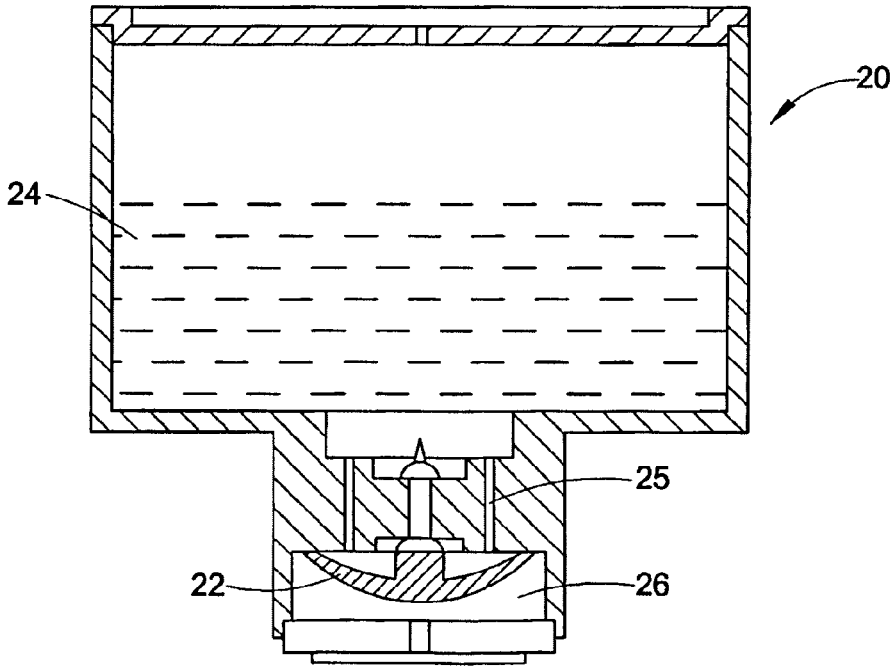
FIG. 2 ( PRIOR ART )
FIG. 2 shows an example of a prior art ink cartridge with a pre-loaded check valve.
Figure 3A:
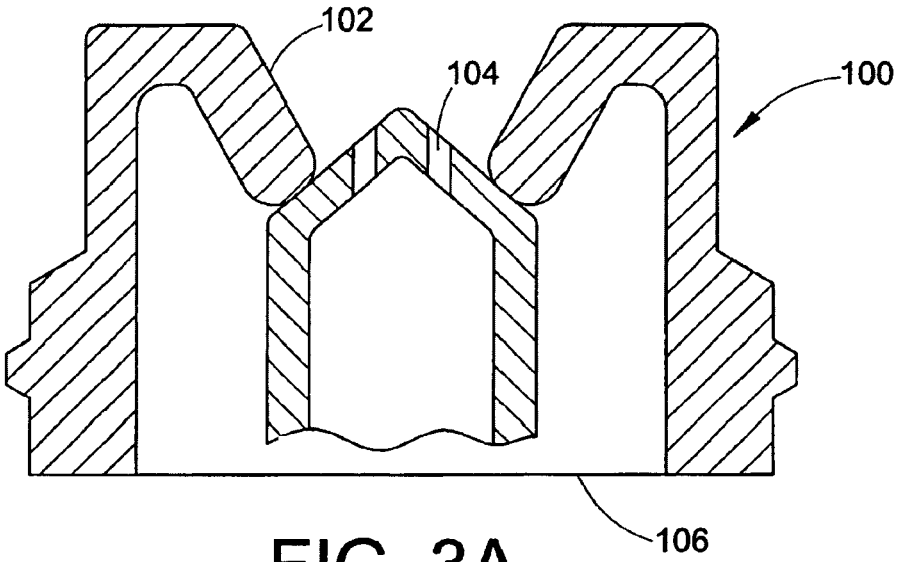
FIG. 3A ( PRIOR ART )
FIG. 3A shows an example of a funnel-shaped sealing member.
Figure 3B:
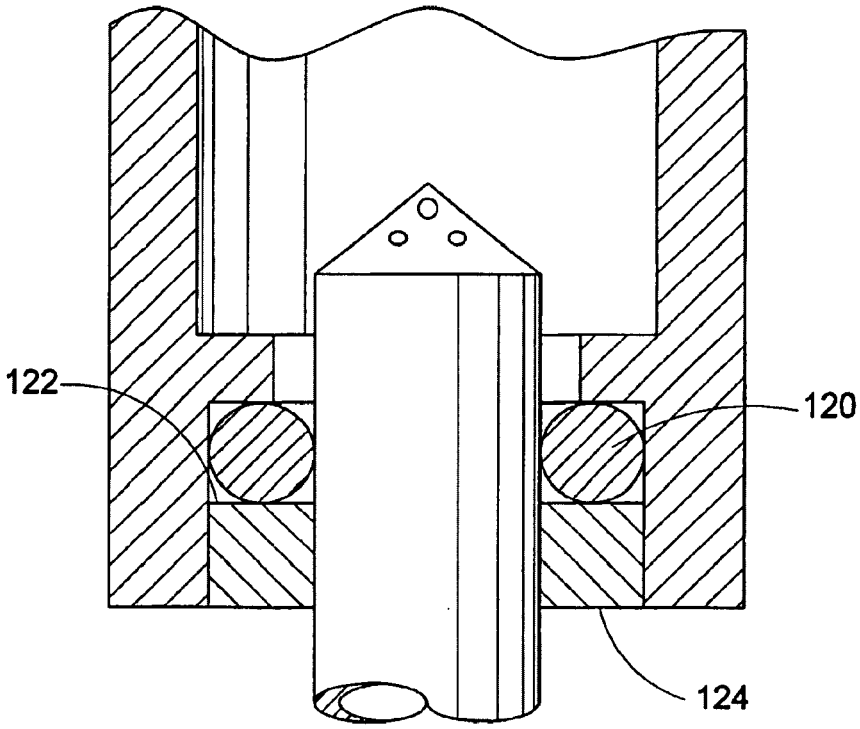
FIG. 3B ( PRIOR ART )
FIG. 3B shows an example of an "O" ring as a sealing member.
Figure 3C:
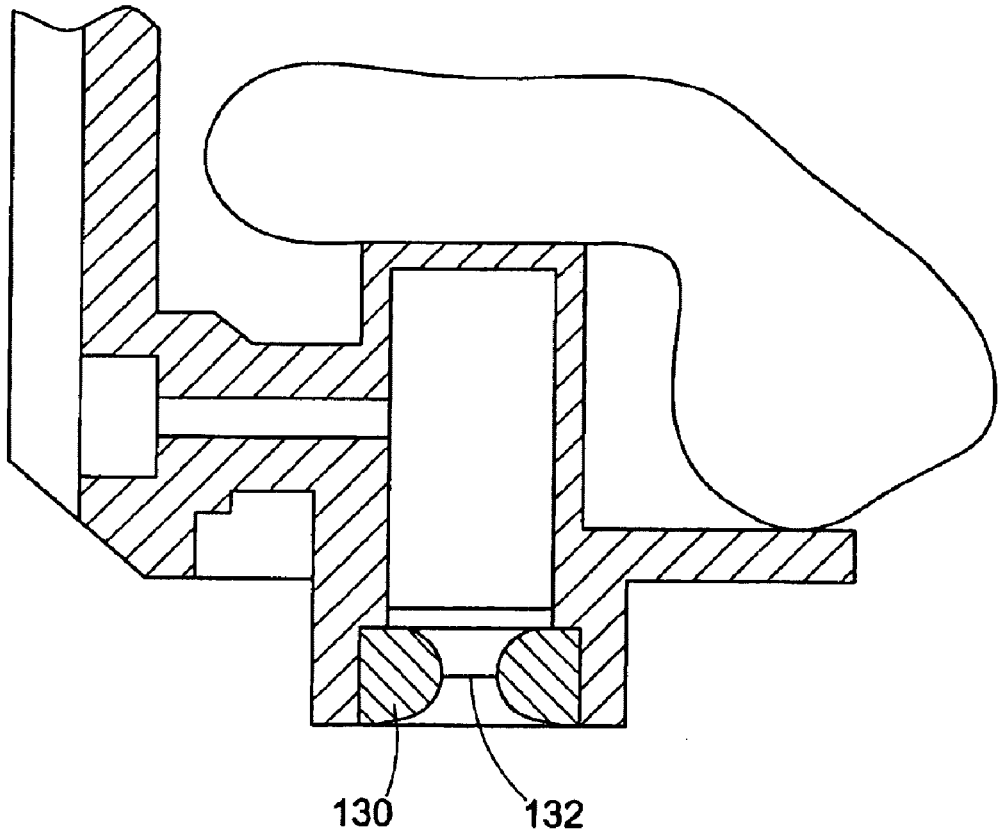
FIG. 3C ( PRIOR ART )
FIG. 3C shows an example of a sealing member provided with a septum.
Figure 4:
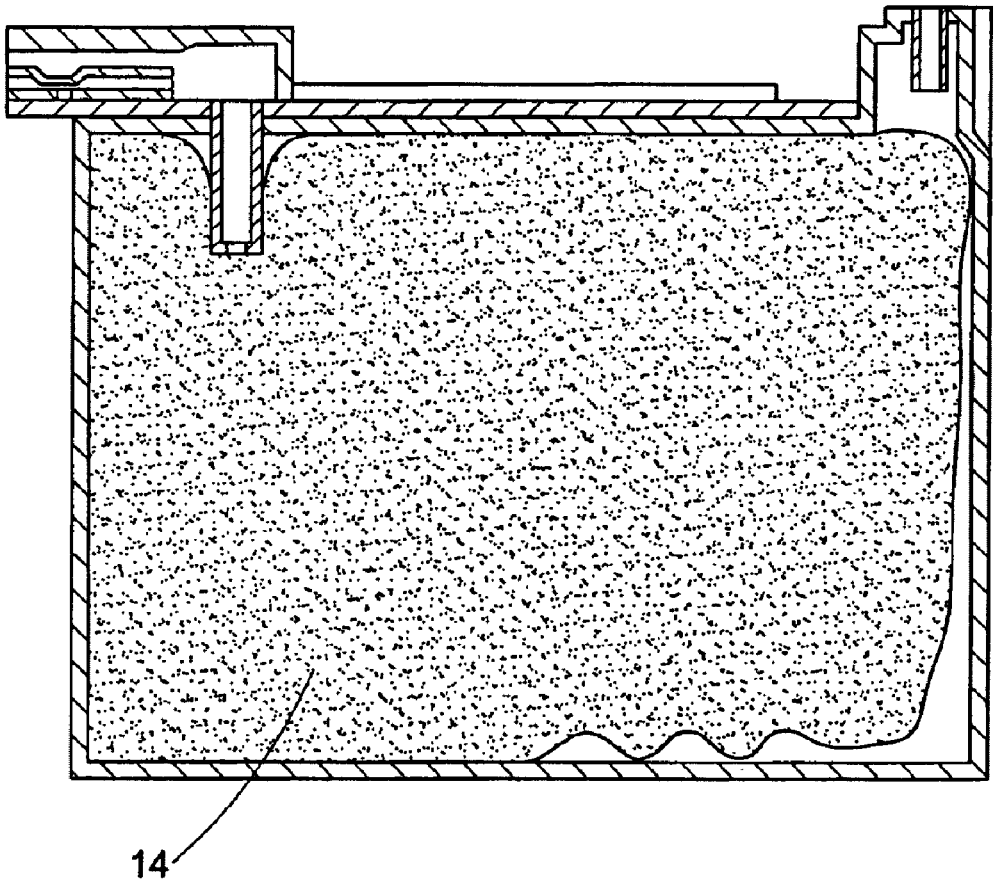
FIG. 4 ( PRIOR ART )
FIG. 4 shows an example of a foam employed in an ink cartridge with "free ink" between the ink chamber and the foam.
Figure 5:
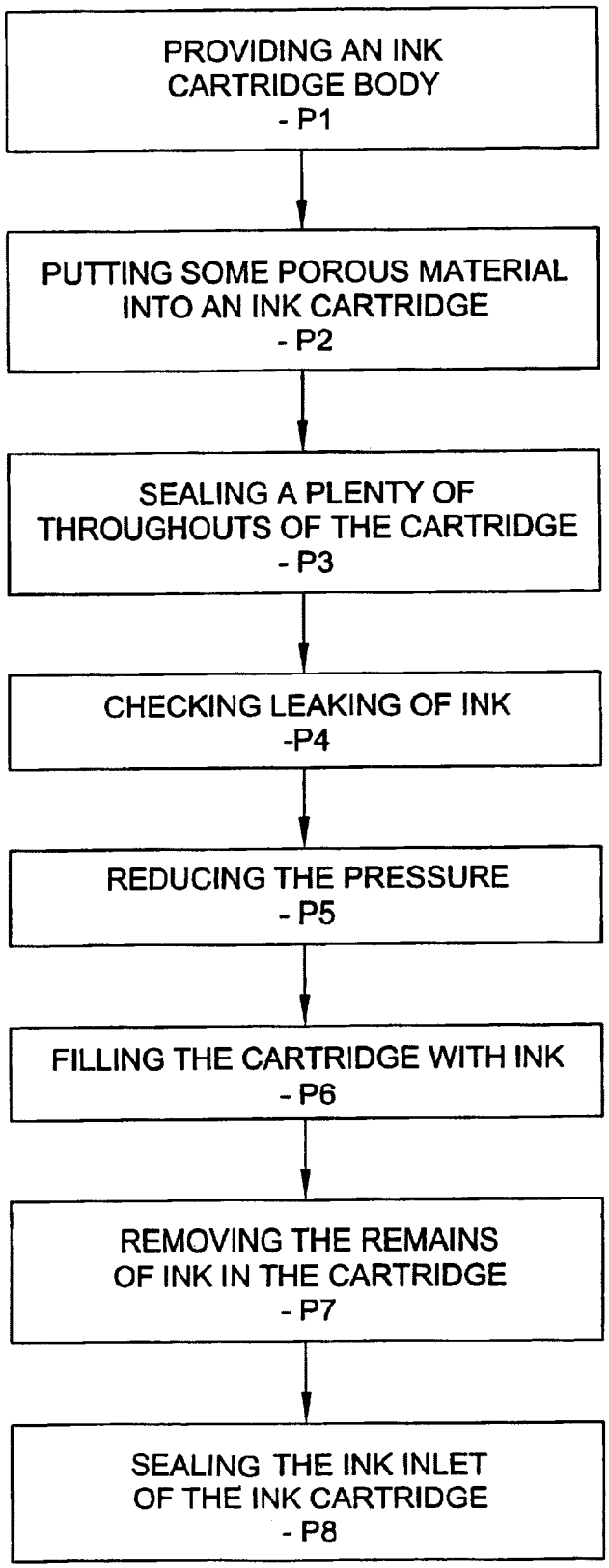
FIG. 5 ( PRIOR ART )
FIG. 5 shows the ink filling process for filling the ink cartridge of FIG. 4.
Figure 6:
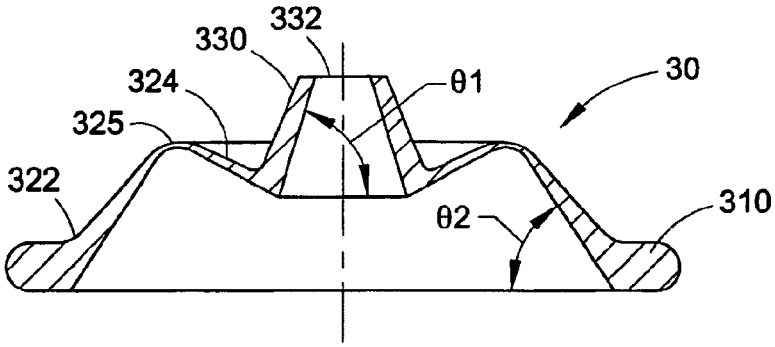
FIG. 6 is a sectional view of the one-way, bellows valve of the present invention.

Referring to FIG. 6, the bellows valve 330 is preferably formed of a rubber with a Shore degree hardness of 30°–65°, and a preferred profile of the bellows is a truncated cone. It includes a foot support portion 310 as shown in FIG. 7A, that abuttingly engages and is supported by an internal wall of the ink chamber 402 adjacent the port 404. The foot support portion is dimensioned for sealing contact with the wall. The enlarged thickness of the foot support portion 310 is reduced along tapered wall support portion 322. That is, the wall thins in cross section and tapers inwardly to a reduced diameter as the bellows merges from the foot support portion toward shoulder portion 324. At the shoulder portion 324, the bellows undergoes a reverse curve 325, the support should portion 324 merging into an inwardly extending support section that defines a well or recess that supports head portion 330. The head portion has an opening 332. The should portion 324 bends inwardly along the wall support portion 322 to support shoulder support portion 324. The contour of the bellows is responsive to subtle pressure differences so that it regulates and control ink flow to the outlet port 404.

Figure 7B:
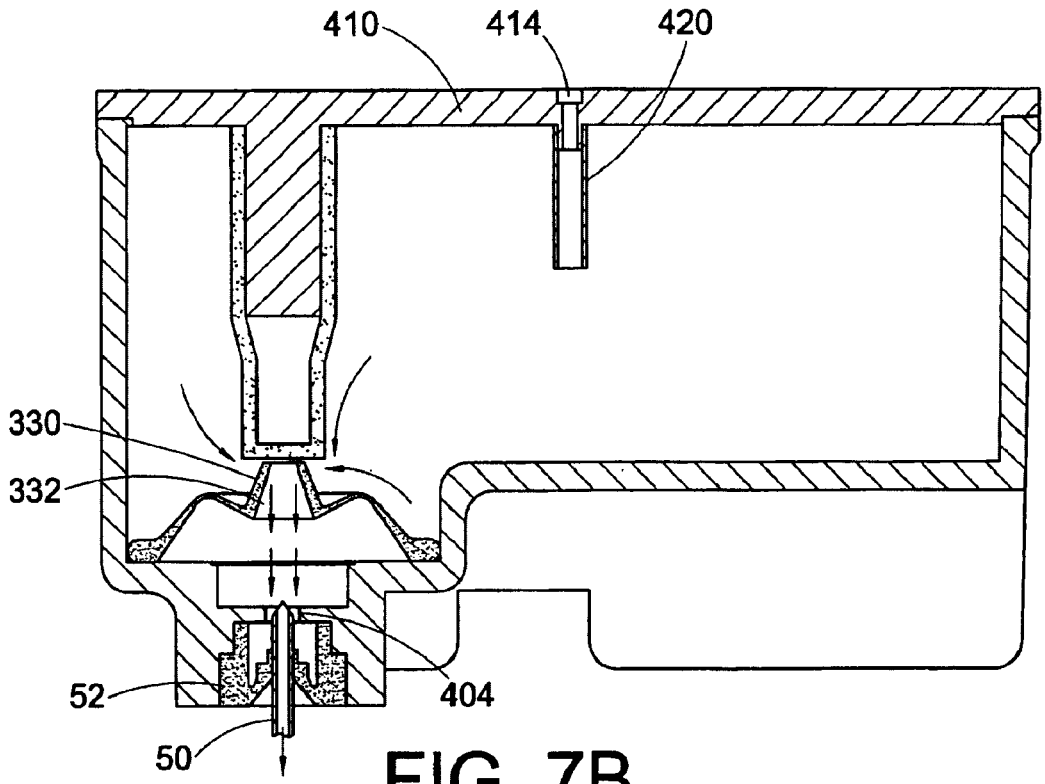
FIG. 7B is a sectional view of an ink cartridge according to a first embodiment and schematically illustrating operation thereof.

When the printer operates, there is a difference of pressure between two sides of the valve, which direction is like the arrows in the FIG. 7B and results in the deformation of the valve. The wall support portion 322 which bends to the inside of the shoulder support portion 324 and forms the sink, guarantees that the supporting head portion 330 moves in response to small pressure changes. In fact, the configuration of the shoulder support portion 324 guarantees that subtle changes result in influence in head support portion 330. Therefore, The configuration of the shoulder support portion 324 provides for a sensitive releasing of pressure.

The movement of the head support portion 330 is greater when there is a large negative pressure difference in order to both control the flow of ink and to reset the head support portion 330 quickly. Therefore the thickness of the foot support portion 310 is greater than that of the head support portion 330 and the supporting shoulder 324 of the valve. It is easy to understand that the head support portion 330 may respond to a small negative pressure and the thickness of a shoulder support portion 324 is designed less than the thickness of the head support portion 330, especially in the shoulder support portion 324 which is 0.15–0.5 mm. The hole 332 of the wall support portion 322 is designed cone-shaped. The head support portion 330 slopes inwardly at an angle θ1 which is less than the slope angle of the foot support portion 310 represented by θ2. An equilibrium condition is obtained when the sloping angle θ1 is reduced in response to negative pressure in the ink chamber as shown in FIG. 6.

The bellows valve 30 is designed inside in the ink cartridge 40 to reserve the liquid ink and control ink flow. Back to FIG. 7A, the bellows valve 30 is located above the outlet of the ink chamber 402, and its supporting foot is connected to the bottom 406. In order to maintain the stability of the valve 30, the bottom wall of the cartridge is provided with a sinking or recessed part 408. The valve sealing device 340 protrudes from the lid 410 of the cartridge directly and seals the supporting head portion 330 and presses it slightly. The preferred method is to provide an elastic shield 342 covering the periphery of the sealing device 340 and that elastically seals with the supporting head portion 330.

Figure 9:
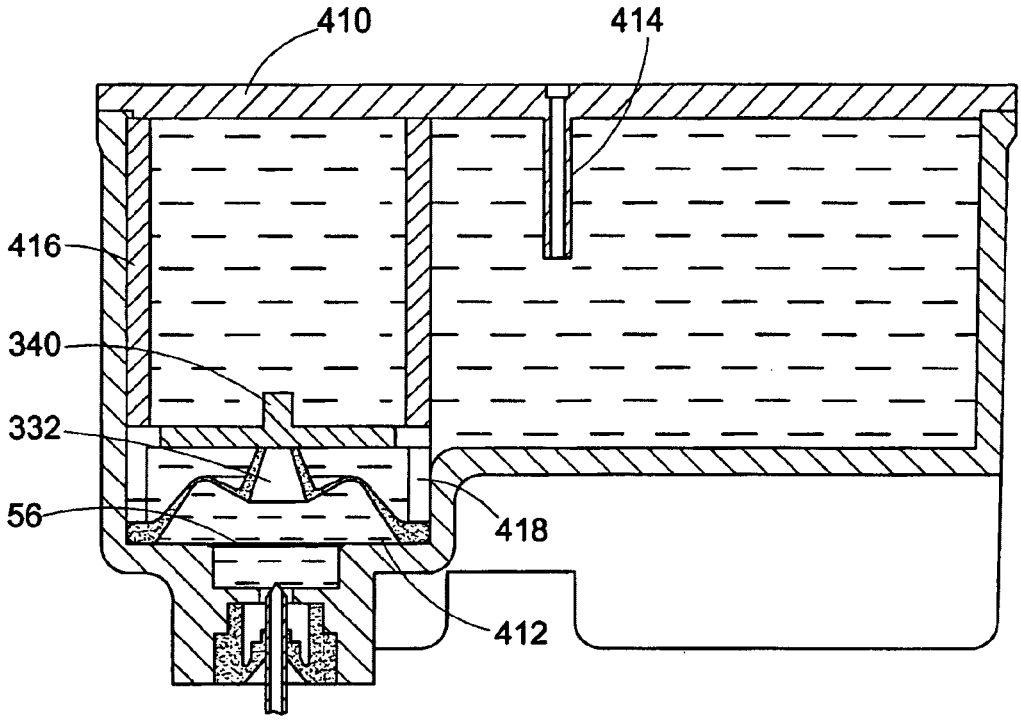
FIG. 9 is a sectional view of an ink cartridge according to a third embodiment of the present invention with a separate valve fixing member.

There are various choices of the sealing device 340, such as a design combined as shown in FIG. 7A or simply fixing the sealing device in the wall 410. According to the demand, for example, where there is a need for a high degree of stability, a cylinder body 416 is fixed above the recess 408. The valve sealing device 340 is a cylinder body with cap and trough 418 shown in FIG. 9, and fixes the valve 30 as well as the valve sealing device 340. Through the trough 418, the ink is provided from the ink chamber 402 to ink guide chamber 412. Alternatively, the valve fixing device may be cylinder pole 416 extending from the wall of tank.

As shown in FIG. 7A, an ink guide chamber 412 is formed by the bellows valve 30 and the recess parts 408 of the wall of the tank 406, its diameter is less than of the supporting foot 310. The ink guide chamber 412 is prefilled with ink, and the head of the printer is supplied with sufficient ink during the printing operation. The needle 50 of the head of the printer is inserted at an external end of the ink discharge opening through an elastic sealing member 52. When in operation, there is negative pressure in the ink guide chamber and there is the pressure difference between the ink chamber and ink guide chamber. So the head support portion 330 of the bellows valve moves down when the degree of pressure reaches a predetermined level, e.g., 120 mm water, and the opening 332 is opened as the valve separates from the sealing device 340, the liquid ink is filled into the ink guide chamber 412 as indicated by the direction of arrow and ink is provided to the print head. According to the valve 30 of this invention, the opening pressure is −200 to 0 mm water and optimum opening pressure is −150 to −30 mm water.

When the operation stops, the bellows valve 30 restores to its initial position, and the bellows valve 30 controls ink flow from the ink chamber 402.

When in use, an air vent must be exposed to balance the air pressure inside and outside of the cartridge. If the negative pressure within the ink chamber increases as the ink chamber is consumed, air communicates into the ink chamber 402 through the air vent 414 to maintain a substantially constant negative pressure. But the residual ink will leak from the air vent when the ink cartridge is moved. Therefore, to prevent ink leaks from air vent 414, the air vent 414 extends into the ink chamber 402 approximately one-third to one-half of the depth of the chamber. This is suitable to prevent ink leakage through the air vent. The extended length can be provide by a rubber tube or soft tube connected to the air vent 414.

A filter 56 is disposed within the ink outlet port for preventing the air and impurity from the needle and improving quality.

Figure 8:
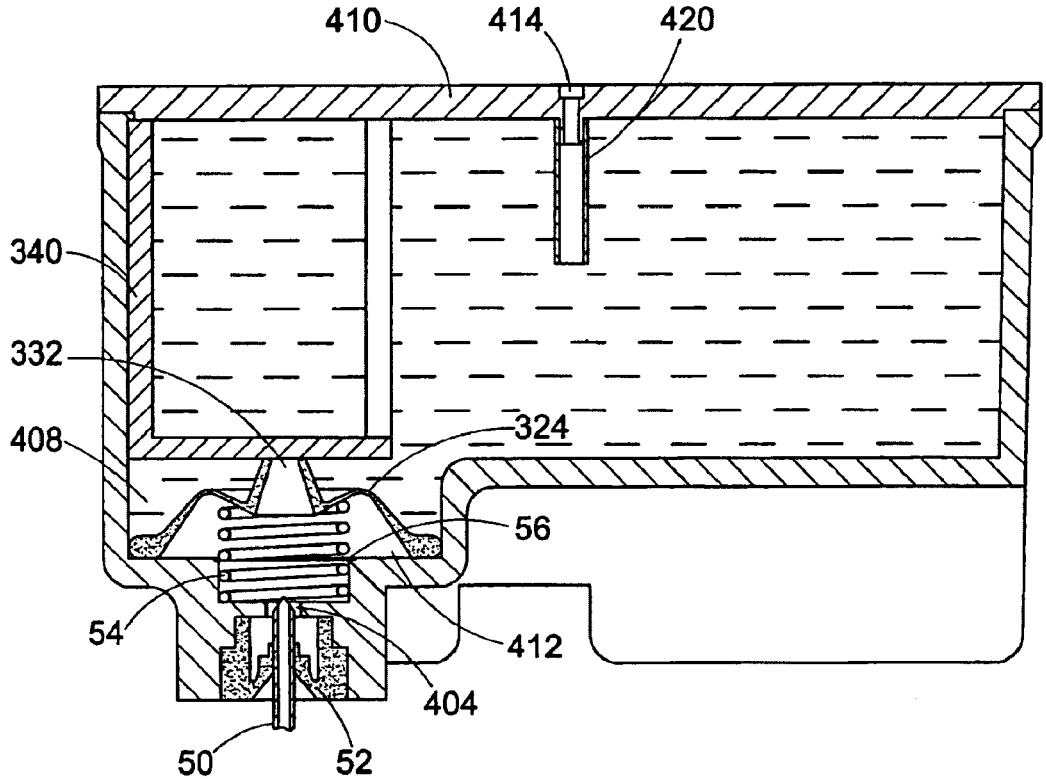
FIG. 8 is a sectional view of an ink cartridge according to a second embodiment of the present invention, showing a spring abutting against the bellows valve.

In FIG. 8, a spring 54 is interposed between the bellows and the lower wall of the cartridge. The spring 54 urges the bellows valve 30 into sealing engagement with the valve sealing member 340 to adjust the pressure sensitivity. A soft tube 420 extends inside to one third of the depth of the ink chamber to prevent ink from leaking.

Meanwhile an air vent 414 may be designed to extend into ink chamber 402 approximately one-third of the depth of the ink chamber.

Figure 10:
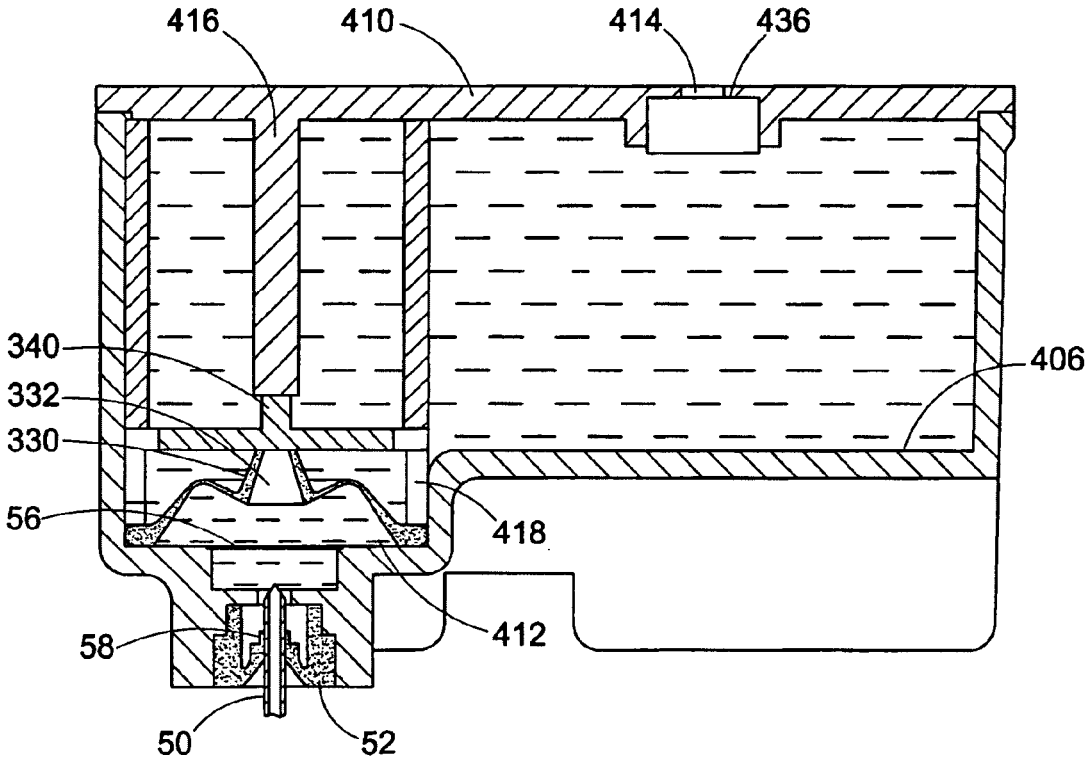
FIG. 10 is a sectional view of an ink cartridge according to a fourth embodiment of the present invention with a protrusion valve fixing member and a porous body disposed in an air vent for preventing ink leakage from the cartridge.

In order to prevent the ink from leaking, there is a porous material 436 located in the air vent 414 for reserving or retaining the ink as shown in FIG. 10.

Figure 11:
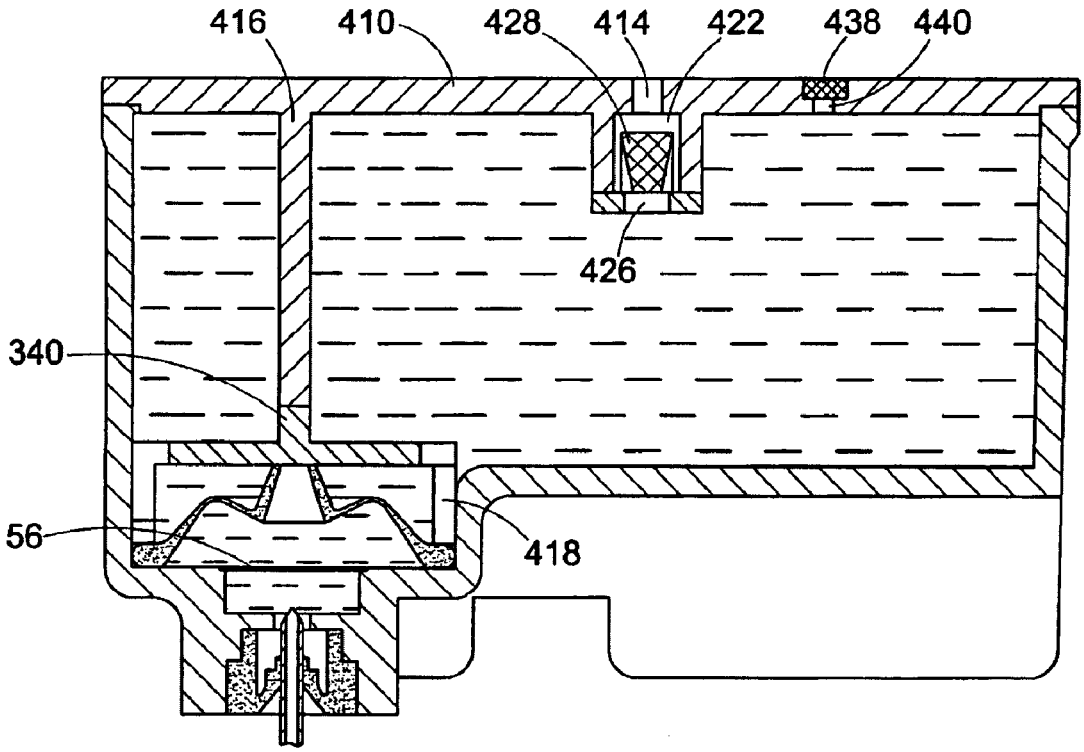
FIG. 11 is a sectional view of an ink cartridge showing a cylindrical valve element to prevent ink leakage from the air vent.
Figure 12A:
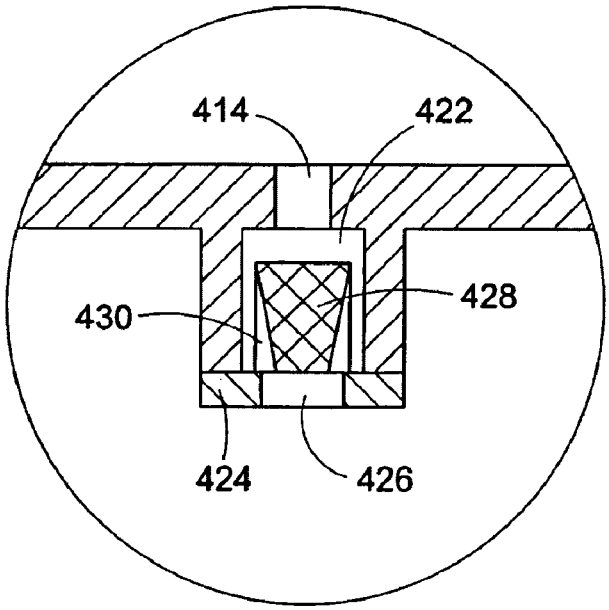
FIG. 12A is an enlarged sectional view of the cylinder valve of FIG. 11.
Figure 12B:
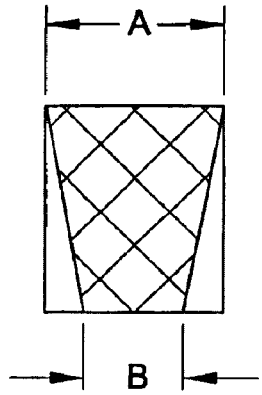
FIG. 12B is a sectional view of the cylinder valve member of FIG. 12A.

In order to prevent the ink from leaking while the ink cartridge is removed from the printer, it is best to locate a one-way valve 428 in the air vent 414, as shown in FIG. 11. Welding a cylinder block 428 with mouth 426 into the chamber of valve 422, results in the trough 430 increasing in size from the end A of the block to the end B, as shown in FIGS. 12A–B. The size of the end A of the cylinder block 428 is greater than the diameter of the air vent 414. But the size of the end B of the cylinder block 428 being less than the block with the mouth 426 provides for both the smooth flow of air, and sealing the air vent 414 with the block 428 when the ink cartridge is removed from the printer head. If a one-way valve 428 is located in the air vent 414 for preventing the ink from leaking, it is necessary to open an ink filling hole 440 for filling ink and to seal it by a stopper 438 as shown in FIG. 11. By leaving the stopper 438 in position, you can refill ink in the ink cartridge conveniently.

Figure 13:
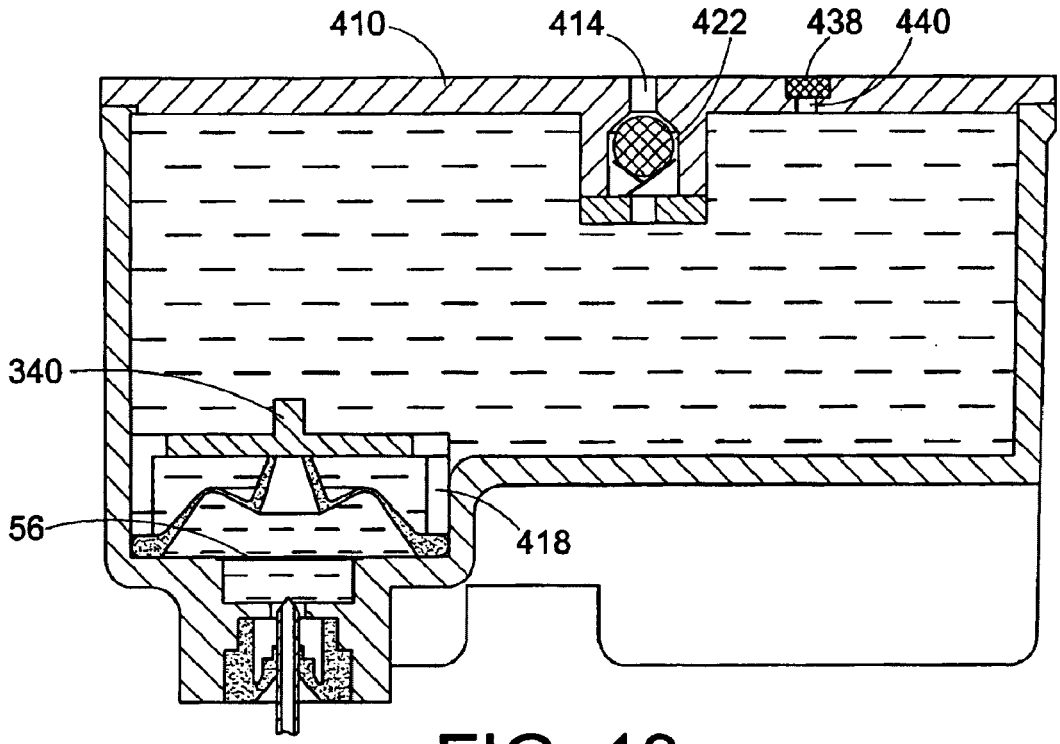
FIG. 13 is a sectional view of an ink cartridge showing a ball valve element that prevents ink from leaking from the air vent.
Figure 14:
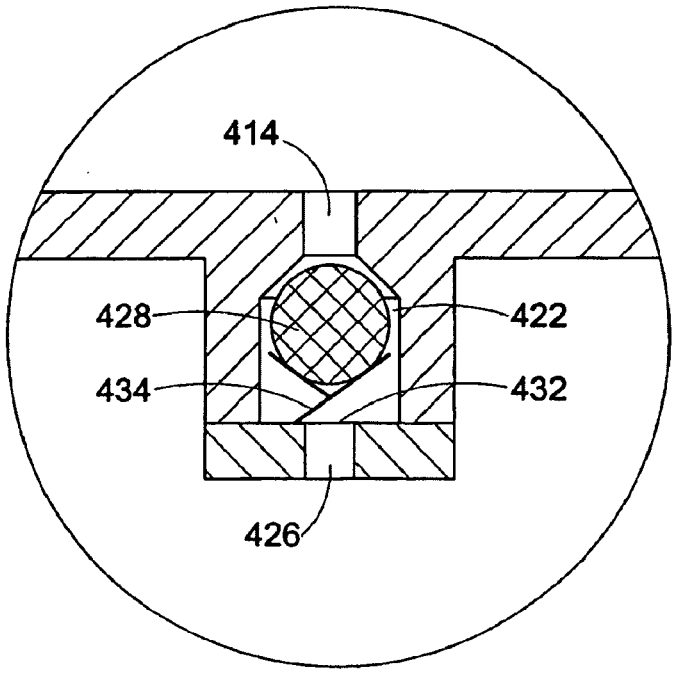
FIG. 14 is an enlarged sectional view of the ball valve of FIG. 13.

As shown in FIG. 13, there is a one-way valve 428 located in the air vent 414, which also can be seen in the enlarged sectional view in FIG. 14. The one-way valve 428 is a ball block and is supported by an elastic flat 434 with a blowhole for smooth air flow between the air vent 414 and the chamber 402.

Figure 15:
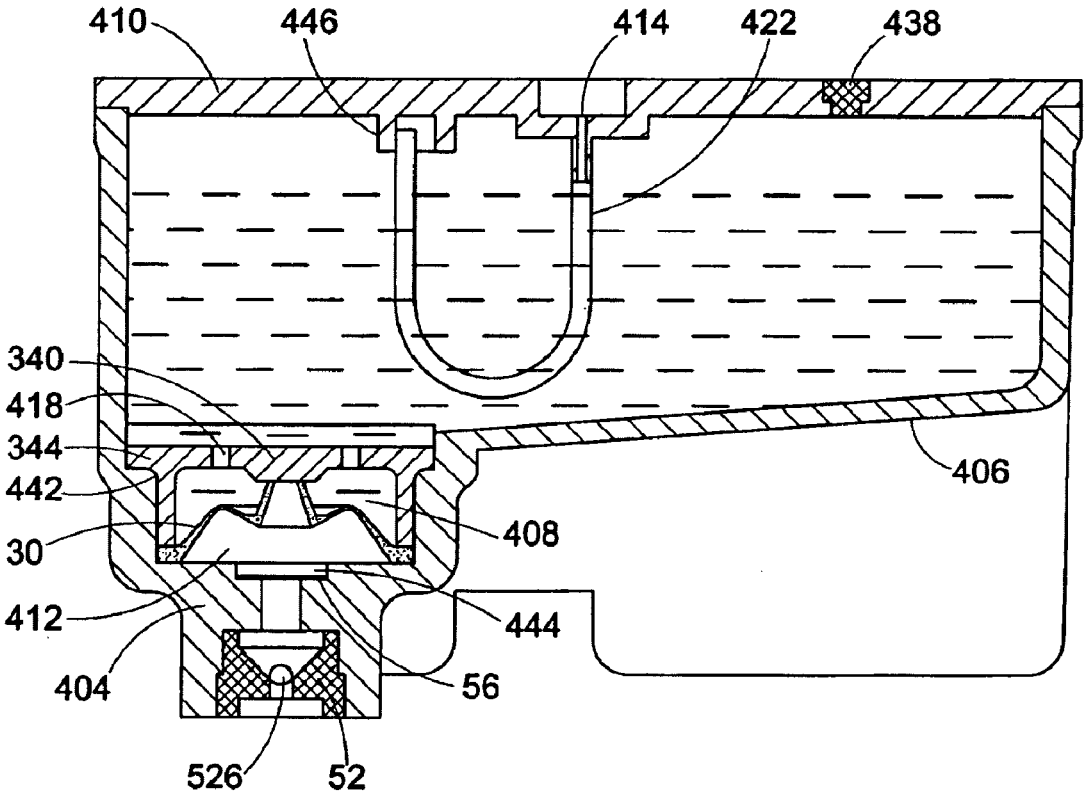
FIG. 15 is a sectional view of a preferred embodiment including a U-shaped tube, sloping bottom wall, and sealing assembly provided within the ink supply port.

As shown in FIG. 15, the direction of the bottom of the ink cartridge is inclined or sloped to the outlet for guiding ink to the outlet. The valve 30 and the valve sealing device 340 are located in the sinking or recessed part 408. There is a step 442 in the wall of the recessed part 408. There is a blowhole 418 and a flange 334 in the top of the valve sealing device 340. The flange 344 conforms to the step 442. The material of the U-shaped tube is rust resistant steel and one end of the tube connects the air vent 414 and another end is over the level of liquid and reaches the inside of the fixed trough 446. A round trough 444 forms at the bottom of the sinking part 408 near the outlet. The mesh filter 56 is welded at the bottom of the round trough 444 for preventing impurities and air bubbles into the outlet 404. The integrated sealing part 52 with the block 526 seals the outlet 404.

For providing the ink steadily, the hardness of the rubber of the sealing assembly is SHORE degree of 25 to 65, preferably 30 to 55. The preferred materials are the following: SBR, EPM, EPDM, butyl rubber, chloroprene rubber, urethane rubber, ethylene rubber, acrylic rubber, and SBP rubber.

Figure 16A:
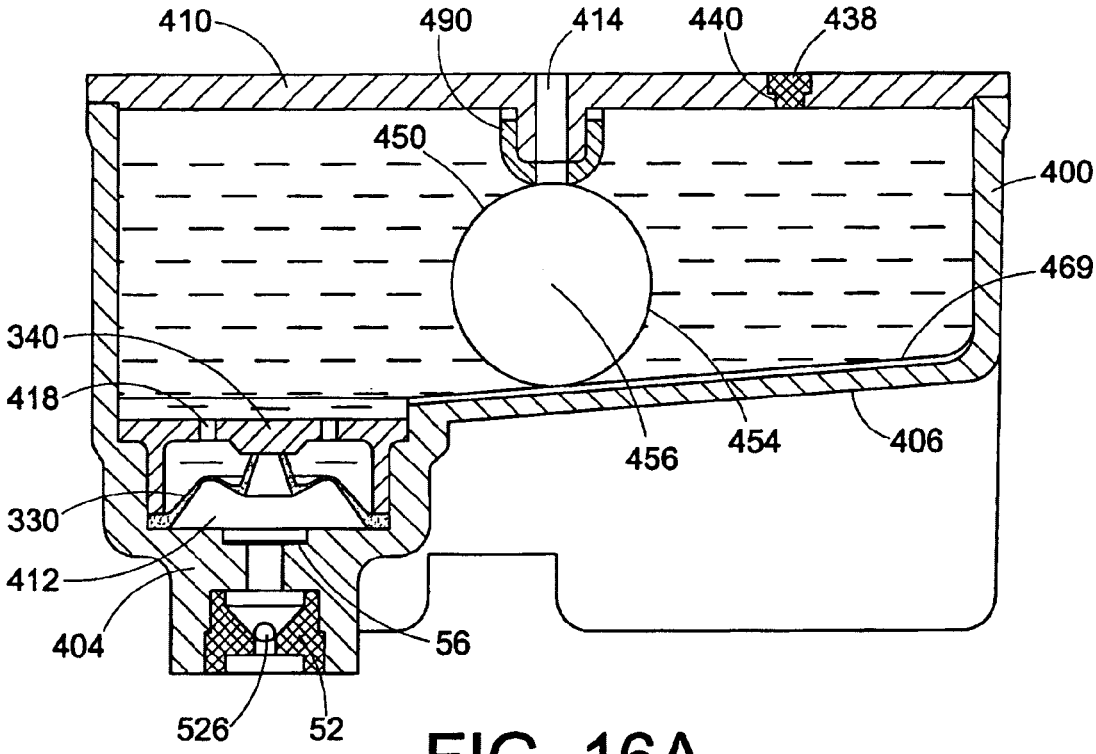
FIG. 16A is a sectional view of a preferred embodiment of the present invention including an elastic bag connected to the air vent for preventing ink leakage.
Figure 16C:
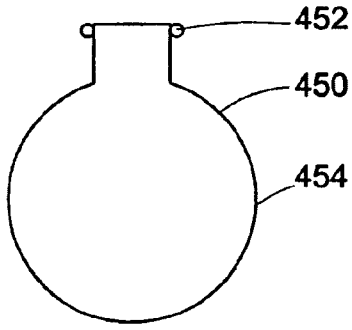
FIG. 16C is a sectional view of the elastic bag of FIG. 16A.
Figure 16B:
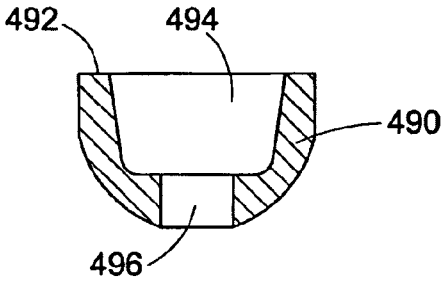
FIG. 16B is a sectional view of the bag fixing cap of FIG. 16A.

As seen in the FIG. 16B, the fixing cap of the bowl 490 has a chamber 494, the ring of shoulder 492 and the blowhole 496 in the middle.

Figure 16D:
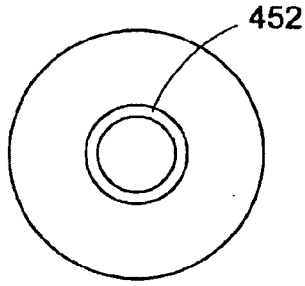
FIG. 16D is a sectional view of of the elastic bag of FIG. 16A.

As seen in the FIGS. 16A, 16C, and 16D, the air vent 414 is located in the middle of the top cap 410 of the ink cartridge. The fixing cap 490 covers the air vent. The balloon 450 is located by the shoulder 492 of the fixing cap 490 by the open mouth 452. The blowhole 496 is connected to the air vent 414 and forms the expanding parts of the air vent 414. There is a blowhole 454 in the wall of the balloon 450, which is made by a needle of a diameter of approximately 0.12 mm. The diameter of the open mount 452 is about 6 mm. The volume of the balloon is about 1.8 ml; the thickness of the balloon is about 0.1 mm. The one-way valve 330 is located near the outlet 404. The sealing cap 340 seals the opening of the one-way valve. There are three holes or troughs 418 in the sealing cap of the valve to allow the ink to flow from the ink chamber 402 to the ink guide chamber 412 under the valve 330, and flow through the mesh filter 56 and to the outlet 404. There are two ink grooves or troughs 470 in the bottom 406 of the ink cartridge 400 for supporting enough ink. Especially when the balloon is expanded, the bottom of the balloon may contact the bottom of the ink cartridge and prevent ink passage but by providing the groove 470 sufficient ink is provided. In order to easily fill ink into the ink chamber, there is a hole 440 in the right side of the top cap 410. When filling is finished, the stopper 438 seals the hold 440. There is a block 526 located in middle of the sealing member 52. The needle of the printer head pushes away the block 526 and lets the ink flow through the needle into the printer when the printer operates.

Figure 16E:
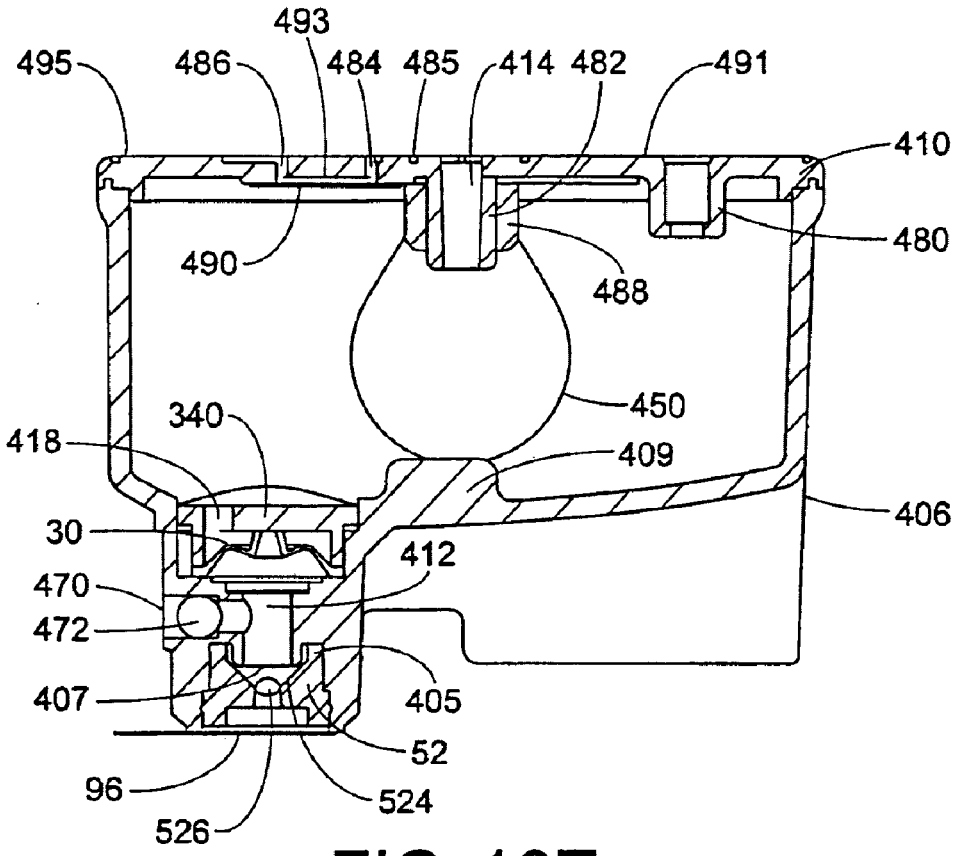
FIG. 16E is a sectional view of an ink cartridge showing an ink guide rib on the bottom wall and labyrinth on the lid.

FIG. 16E shows the case according to a preferred embodiment of the present invention. In order to provide the liquid ink, the bottom 406 of the ink chamber is inclined or sloped to the outlet 404. The balloon expands and can possibly block the hole 418 of the valve sealing device to stop the flow of the ink; therefore there is an ink guide rib 409 in the bottom to support the balloon 450 and prevent its blocking of the hole 418.

When the printer is in operation, the balloon 450 expands gradually with the continual ink flow. When the balloon enlarges to a certain volume, the hole 454 in the wall of the balloon is opened and air is supplemented into the ink chamber for the balance of pressure as well as to guarantee the quality of printing. When the operation is finished, the hole is closed by means of the elastic nature of the balloon and prevents the ink from flowing into the chamber of the balloon. The hole 454 in the wall of the balloon 450 plays a certain role like a one-way valve and opens or closes according to the needs of printing. Meanwhile, as the temperature of the environment changes, the air in the ink cartridge will expand with the increased temperature and press on the balloon. As the result, the air in the balloon is squeezed out in order to retain the balance of the pressure in the ink cartridge and prevent ink leakage. Especially when the ink cartridge is thrown away after being used up or for other reasons, where there are more amounts of ink remaining in the ink cartridge in the latter situation, the ink cartridge may be placed upside down. In above situation, according to the principle, if the volume of the ink cartridge is 14 ml and the temperature rises up by 30 degrees and the enlarged ratio is 10% of original one, then the air enlarges to 1.4 ml but the volume of balloon is 1.8 ml.

That means the enlarged volume of the balloon is enough to cancel the volume of the expanding air in the ink chamber. Thus, the air expanded in the ink chamber presses the air out of the balloon in order to balance the pressure in the ink chamber and prevent ink leakage.

Figure 16F:
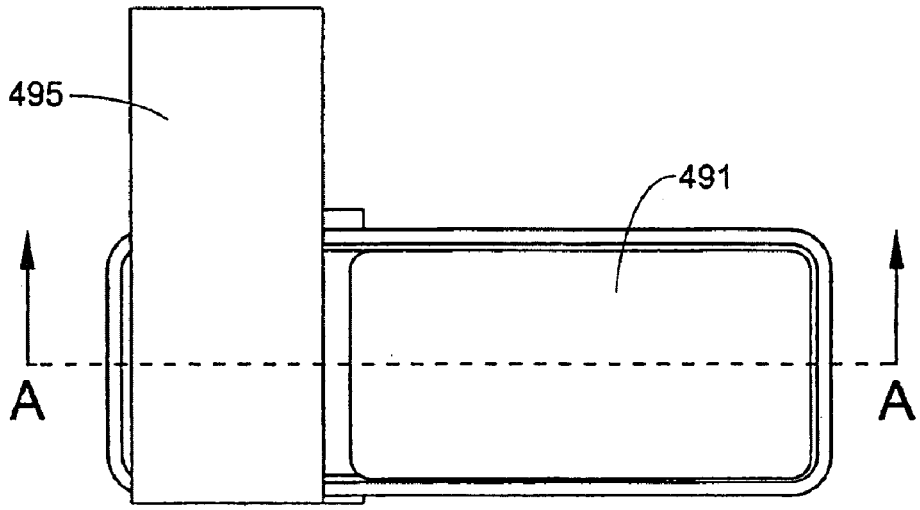
FIG. 16F is a top view of the lid of an ink cartridge showing an air guide film covering the labyrinth.

There are some irregular labyrinth grooves 484, 485 and 486 provided in the wall of the cartridge, that individually connect with the air vent 414. When operating, air flows from the labyrinth groove 486 to groove 484, and from the hole 485 to the inside of balloon 456. The labyrinth grooves 484–486 are located on the surface of the cover 410, therefore the surface of the irregular labyrinth grooves 484, 465 and 486, are individually sealed by the package seal 491 and 495 for transport, as shown in FIG. 16F. Before usage, the package seal 495 is peeled off to expose part of the labyrinth groove. The film seal 96 will be pierced by the ink supply needle.

There is a circular protrusion 405 in the wall of the chamber for supporting the sealing parts 520. The inside of the protrusion 405 engages with the upper or top side 524 of the sealing parts to strengthen the stiffness and to facilitate the separation of the block portion from the sealing member.

As a part of the filling process there is a hole 440 in the wall of the outlet. The hole connects with the top chamber of the sealing part and is sealed by plug 472.

Figure 17:
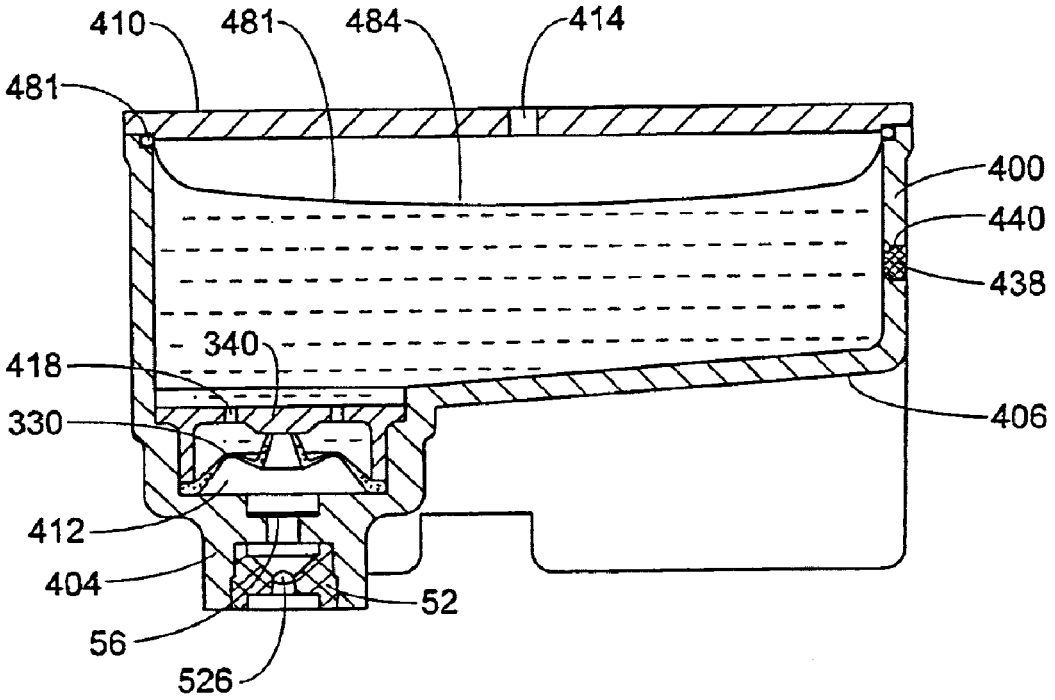
FIG. 17 is a sectional view of an ink cartridge showing a membrane being connected to the lid where the air vent is disposed within the lid.

FIG. 17 is another example of the device of preventing ink from leaking according to a preferred embodiment of the present invention. The device is an elastic membrane 480 which connects to the cap 410 of the cartridge 400 by the mouth 481. There is a blowhole 484 in the bottom of the elastic membrane 480. The principle of the ink cartridge and preventing the ink leakage are both the same as described with reference to the embodiment of FIG. 16.

Figure 18A:
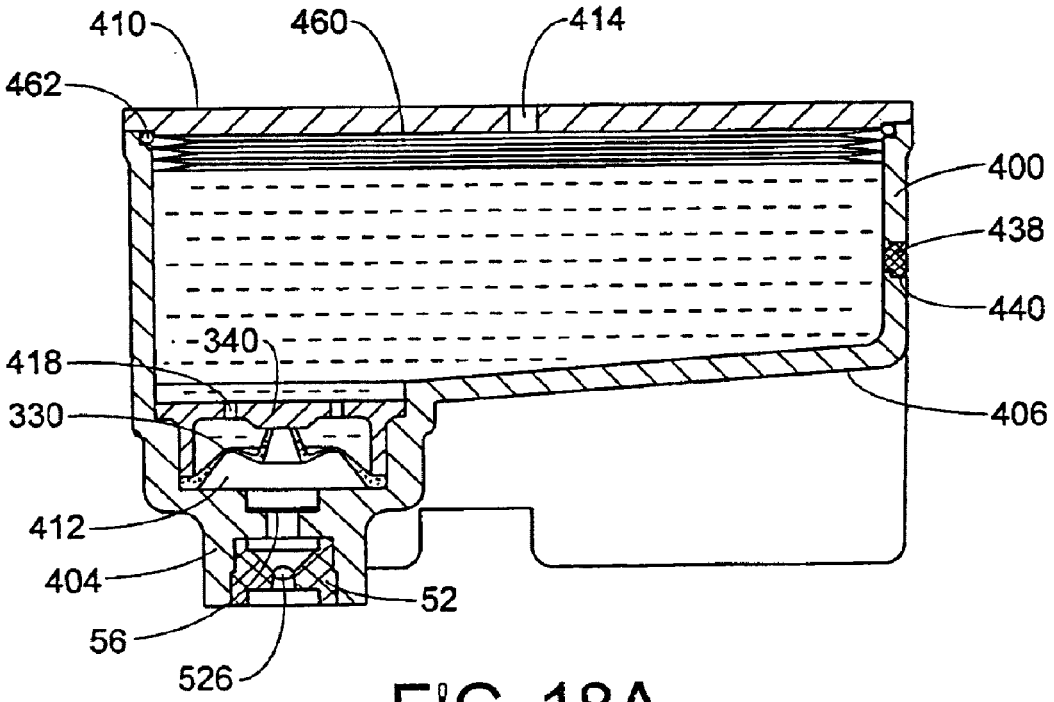
FIG. 18A is a sectional view of an ink cartridge showing a bellows like member being connected to the lid with the bellows like member in its relaxed state.
Figure 18B:
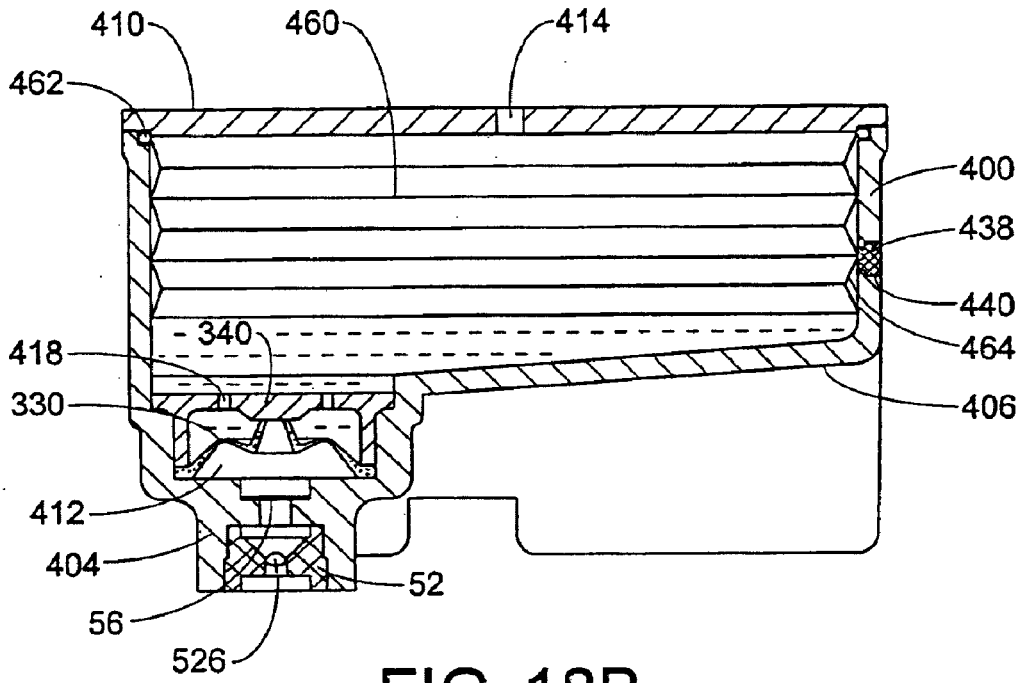
FIG. 18B is a sectional view of an ink cartridge of FIG. 18A, showing a bellows like member being connected to the lid with the bellows like member in its working state.
Figure 18C:
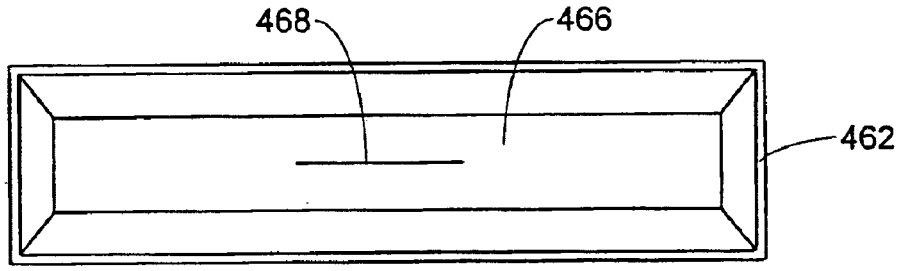
FIG. 18C is a sectional view of the bellows like member of FIG. 18A.

FIG. 18A and FIG. 18B is another embodiment of the present invention, in which the like reference numerals are used for like elements as in FIG. 16A. The plastic balloon 460 is made by nonelastic materials and is provided with folded layers. The plastic balloon 460 connects to the lid 410 of the tank 400 by the opening 462. The ink filling hole 440 is located at the wall of ink cartridge 400. When working, the ink flows from the outlet 404 and air enters the plastic balloon 460 through the hole 414 and lets the plastic balloon stretch slowly until the folded layers 464 are fully opened which stretches the plastic balloon 460. The mouth of the plastic balloon 460 is a rectangle, with its length 47 mm and width 14 mm as shown in the FIG. 18. If the folded layers are fully opened and the ink is not used up, a slit 468 is required in the bottom of the plastic balloon 460 in order to supply some air to balance the pressure in the ink tank for continued printing. The principle of the ink cartridge and preventing the ink leakage are both the same as in FIG. 16A.

Figure 19A:
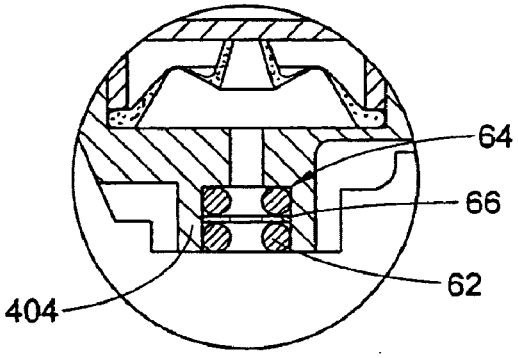
FIGS. 19A–19E are sectional views of alternative sealing assemblies within the ink supply port provided on the outlet of FIG. 15.
Figure 19B:
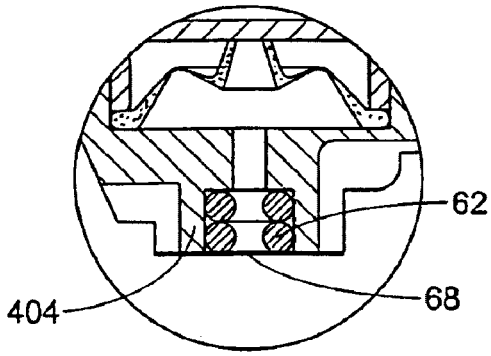
Figure 19C:
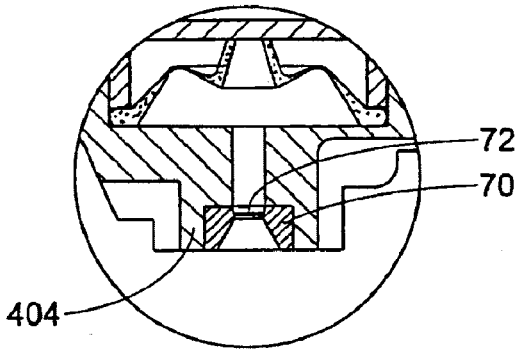
Figure 19D:
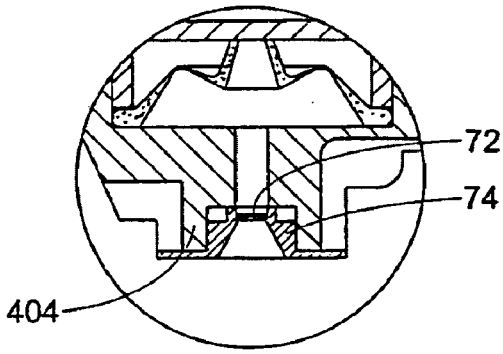
Figure 19E:
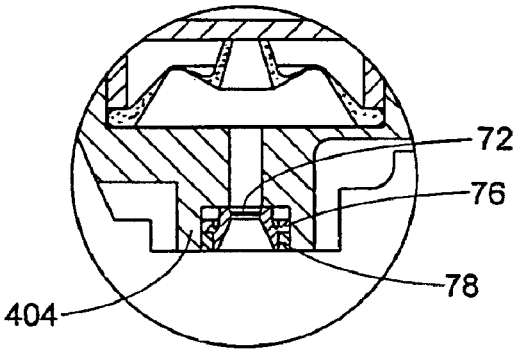

FIGS. 19A–19E disclose additional, alternative embodiments for sealing assemblies received in the ink supply port 404. Thus, it will be understood that the remainder of the structure is substantially identical to that shown and described with respect to the embodiment of FIG. 16A. Although the sealing assemblies of FIGS. 19A–19E are differently shaped and configured, each sealing assembly basically functions and operates in the same manner. In the arrangement shown in FIG. 19A, a plastic sealing piece 64 is fused with a plastic ring 66 provided between first and second O-rings 62. In FIG. 19B, a plastic sealing piece 68 is disposed in the outer opening of the ink supply port 404. In FIG. 19C, a uniform-shaped sealing member 70, with a septum 72 is disposed within the ink supply port 404. In FIG. 19D, a cap-like sealing member 74 is provided with a septum 72 and disposed in the ink supply port 404. Last, FIG. 19E shows a cap-like sealing member 76 provided with a steel ring 78 disposed within the ink supply port 404 that includes a septum 72.

Figure 20A:
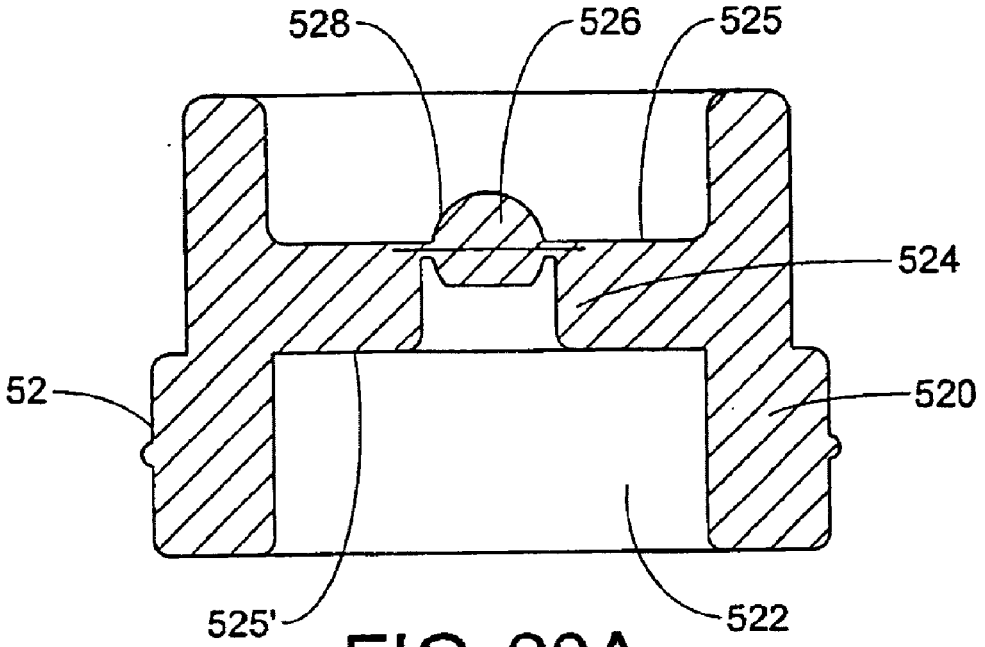
FIG. 20A is a sectional view of alternative sealing assemblies integrally formed within a ball-like block portion.

FIG. 20A is still another preferred embodiment according to the present invention which includes a seal assembly 52 having a block portion 526 that is selectively separated via a frangible connection 528. The seal assembly 52 is made of an elastic material with Shore hardness 30~50 degree. When an ink supply needle is inserted through sealing portion 524, the block portion of the seal assembly at least partially separates from the remainder of the seal assembly.

Figure 20B:
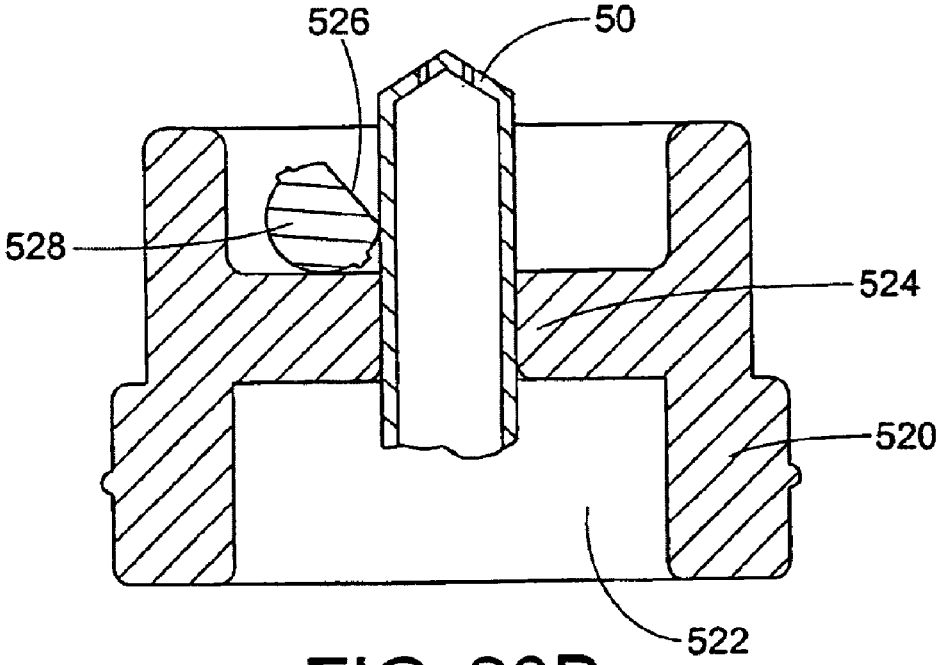
FIG. 20B is a sectional view showing the ball-like block portion of FIG. 20A separated from the sealing assembly upon the insertion of a printer needle.

Preferably, the block portion 526 has a generally planar surface for engagement by the ink supply needle making it easy to push. The sealing portion 524 is horizontally dimensioned to maintain the block portion upon insertion of ink supply needle 50. As shown in FIG. 20B, the seal assembly 52 allows the ink supply needle to pass therethrough by breaking the frangible web 528. Thus, the outer diameter of the ink supply needle is engaged in sealed manner by seal portion 524. The preferred width value for the connection portion is between 0~0.3 mm and the preferred thickness of the connection portion is between 0.15~0.4 mm.

Figure 21A:
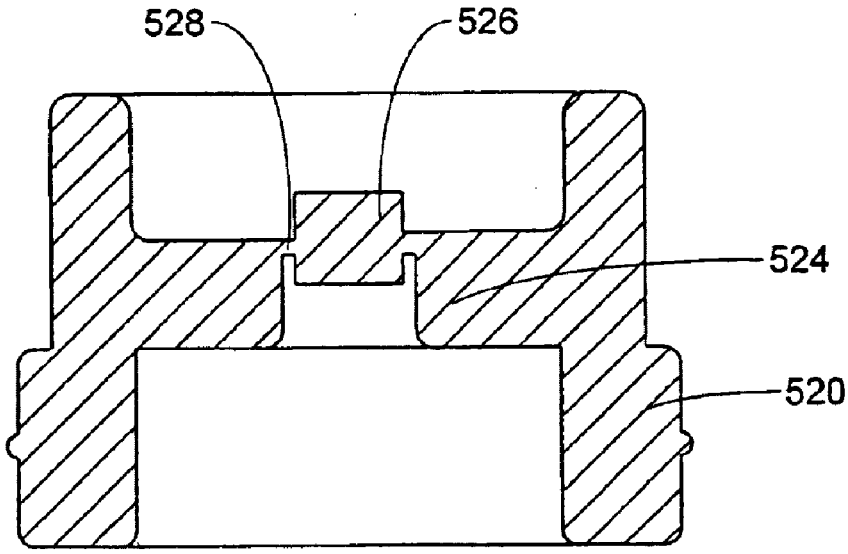
FIG. 21A is a sectional view of alternative sealing assemblies integrally formed within a cylindrical block portion.
Figure 21B:
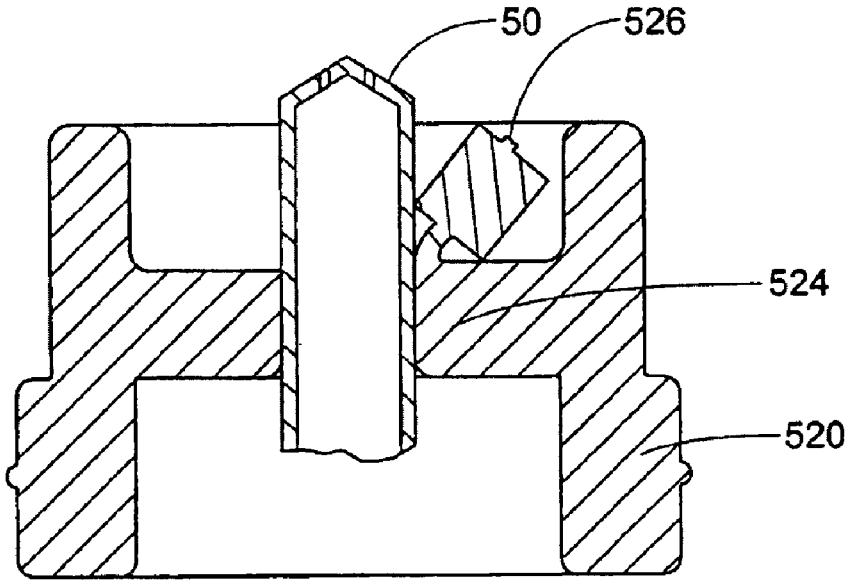
FIG. 21B is a sectional view showing the cylindrical block portion of FIG. 21A separated from the sealing assembly upon the insertion of a printer needle.
Figure 22:
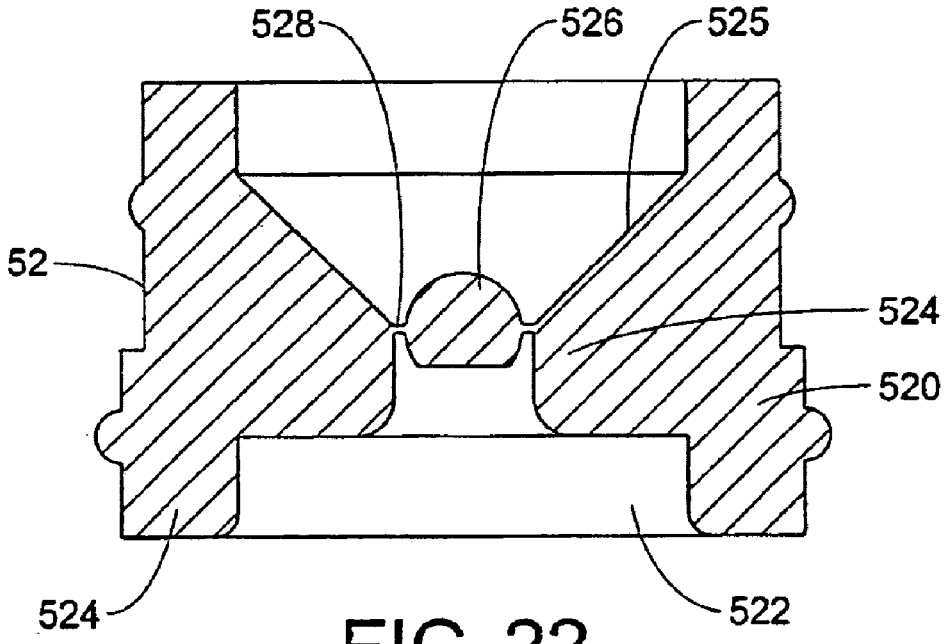
FIG. 22 is a sectional view of alternative sealing assembly provided with an inwardly tapered surface.
Figure 23A:
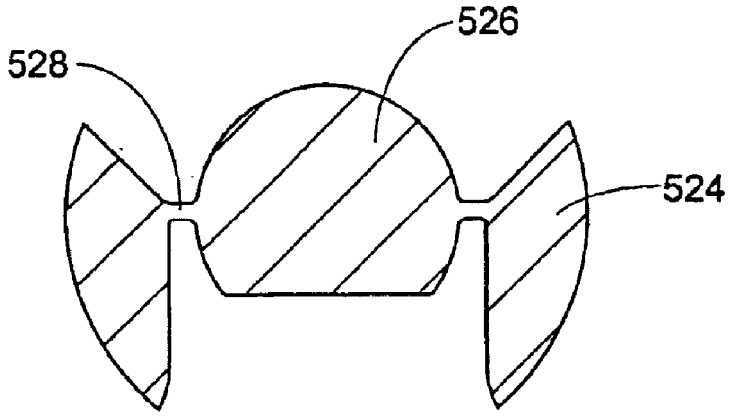
FIG. 23A is a preferred embodiment of a connecting portion integrally provided on a sealing assembly, showing that the connection portion possesses average thickness.
Figure 23B:
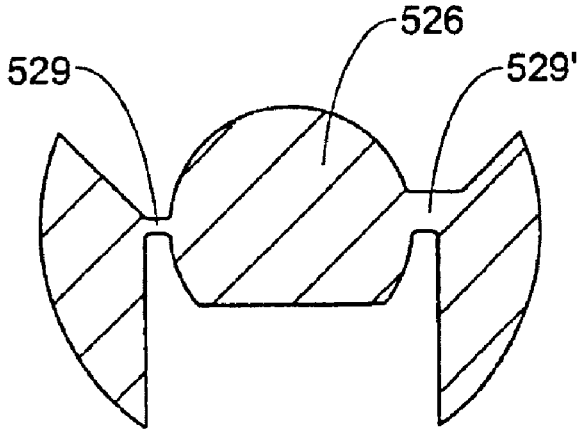
FIG. 23B is another preferred embodiment of a connecting portion integrally provided on a sealing assembly, showing that the connection portion possesses different thicknesses.

In FIG. 21A, connection portion 528 is thinner on one side than the other side. This assures that the block portion 526 is separated along the thinner web and remains connected to the sealing portion by the thicker web, as illustrated in FIG. 21B. In FIG. 22, a major distinction when compared to the other seal assembly embodiments is the configuration of the block portion, here, the block portion has a generally cylinder shape. Again, the block portion is connected to the seal assembly by a thin frangible web portion 528 on one side and a thicker web portion on the other side which retains the cylindrical block once it is punctured by the needle. A tapered surface 525 is provided inwardly of the sealing assembly to facilitate separation of the block portion 526 from the thin web. The tapered surface 525 is to facilitate the block portion being pushed upward, the sloping angle formed between the tapered surface 525 and the lateral direction is preferably around 30~45 degrees. The configuration of FIG. 23A shows the connection portion 528 is an average thickness and FIG. 23B illustrates that the web can be thinner on one side 529 than on the other side 529'. The thickest portion 529 is between 0.3~0.4 mm and the thinnest portion is between 0.15~0.25 mm.

Figure 24:
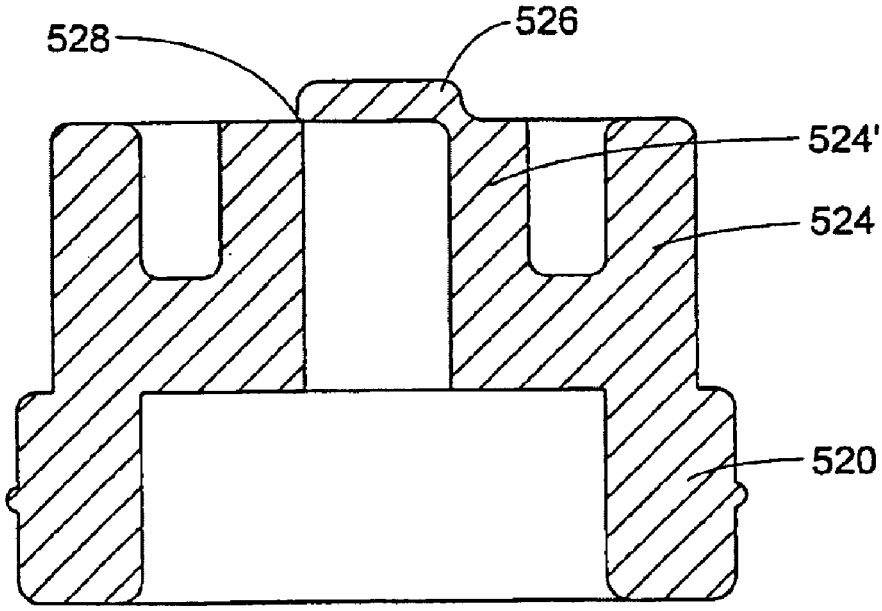
FIG. 24 is a sectional view of a still further alternative embodiment of sealing assembly.

Sealing portion 524 in the embodiment of FIG. 24 is elongated in the needle insertion direction. A gate portion 526 has a generally cylindrical shape and is provided in closing relation at one end of the sealing portion 524. Again, a connection portion or thin frangible web 528 is thinner on one side than on the other side to allow the sealing portion to hinge along section 524. As an ink supply needle (not shown) is advanced through the seal assembly, the thin frangible web is broken and seal portion pivots about the hinge 524'. In addition, the elongated sealing portion 524 engages with the outer diameter of the ink supply needle in sealed manner.

The sealing part is designed integrally and meets the different demand, such as assembly and transport as well as in operation, therefore the sealing film for the ink supply needle to pierce in the outlet is reduced, and the difficulty of piercing through the septum of the sealing member of the traditional ink cartridge has been overcome.

Figure 25A:
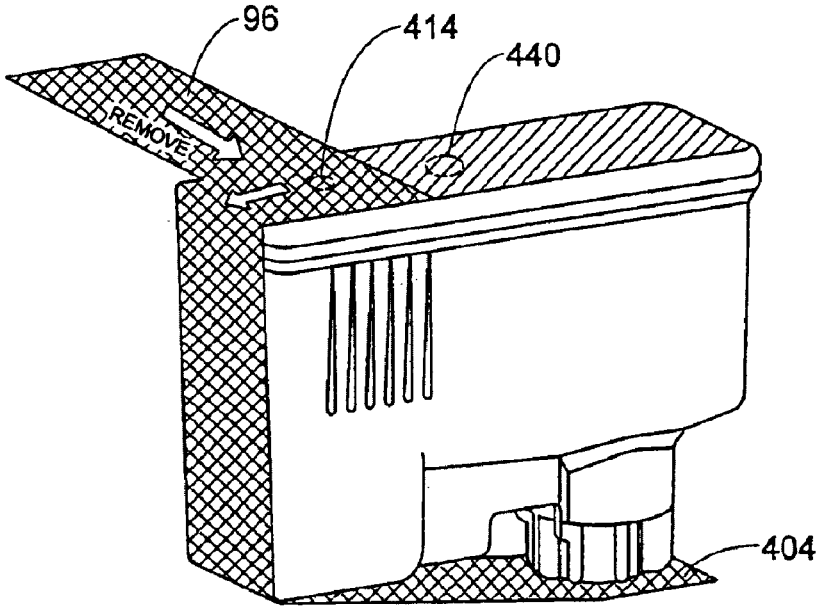
FIGS. 25A–25B are perspective views of a package seal used for sealing the ink cartridge during shipping and handling.

Referring to FIG. 25A, air vent opening 414 is spaced from ink port 404. Thus, package seal 96 is configured to cover both the air vent opening 414 and the ink port 404 to prevent ink leakage during shipment. A portion of the package seal as represented by arrows as shown in the figure, is to be removed once the cartridge is ready for insertion by lifting upwardly on the tongue before the cartridge is inserted. The remainder of this foil seal strip then proceeds toward the ink supply port 404 which is also opened by removal of the package seal. Removing the package seal exposes the air vent 414 and the ink supply port 404. Thus, the ink chamber is placed in fluid communication with the air vent. The ink supply port 404 is then positioned for alignment with the ink supply needle (not shown).

Figure 25B:
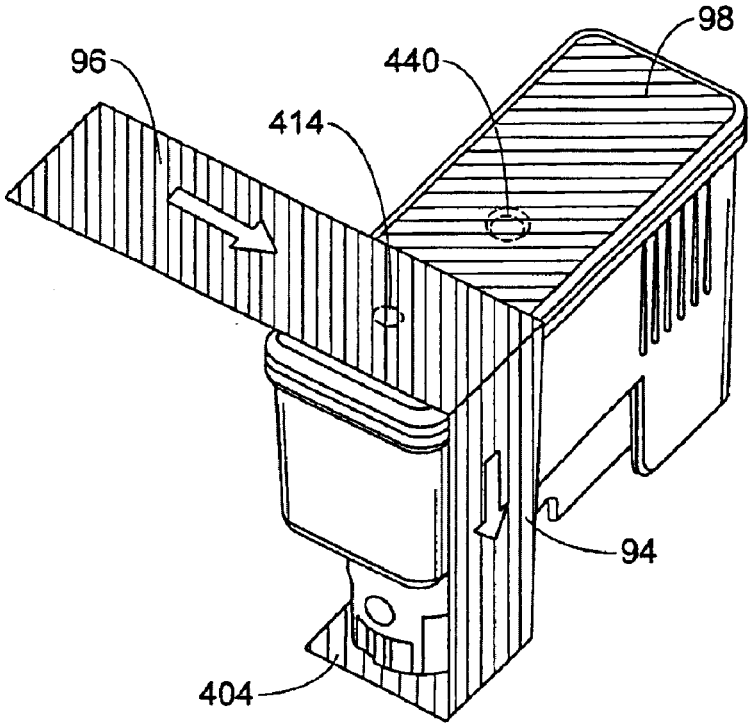

The embodiment of FIG. 25B illustrates an arrangement where the air vent and the ink supply port are both closed at the same vertical side of the cartridge. The foil seal 98 is provided to permanently seal the fill hole 440 provided in a cover or lid 410 of the ink cartridge. The package seal 96 coupled with a connection portion 94 is fixed to the ink cartridge during shipment but is intended for removal by pulling upwardly.

Figure 26:
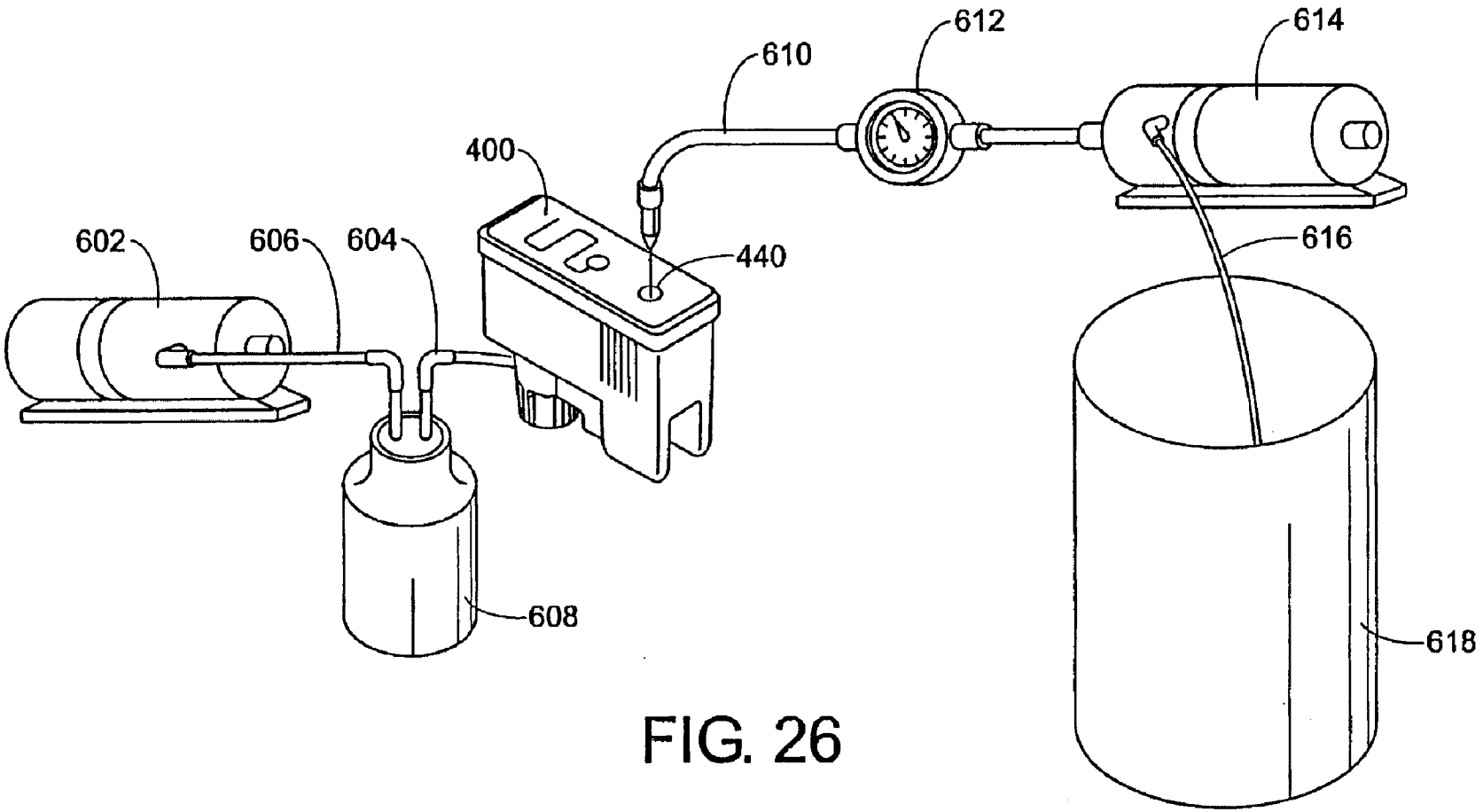
FIG. 26 is a perspective view of the ink filling device of the present invention filled under positive pressure.

Referring now to FIG. 26 and FIG. 16E, it shows the ink filling to the cartridge 400 under a positive source of pressure. First, ink is reserved in a vessel 618, the vessel 618 connecting to the one side of the pump 614 through the ink tube 616; the other end connects to the ink cartridge 400 through the tube 610. There is a flow meter 612 in the middle of the tube 610 for controlling the amount. When filling up to a predetermined level in the ink cartridge, the filling is stopped. Then a needle 604 is inserted into the hole 440 while another end of the needle connects to the pump 602 through the soft tube 606. There is an air and liquid separator 608 in the connecting part between the soft tube 606 arid a needle 604 for separating the air and liquid. When the pump works, air in the ink chamber 402 will be withdrawn, at that time there is a difference of pressure on opposite sides of the valve 30 and it causes the valve 30 to separate from valve sealing cap 340. As a result, the ink is withdrawn from the ink chamber 402 and fills the ink guide chamber 412 through the hole 418 of the valve sealing cap 340 and the hole 332 of the valve 30. Inserting the plug 438 into the ink filling hole 440 finishes the filling operation.

Figure 27:
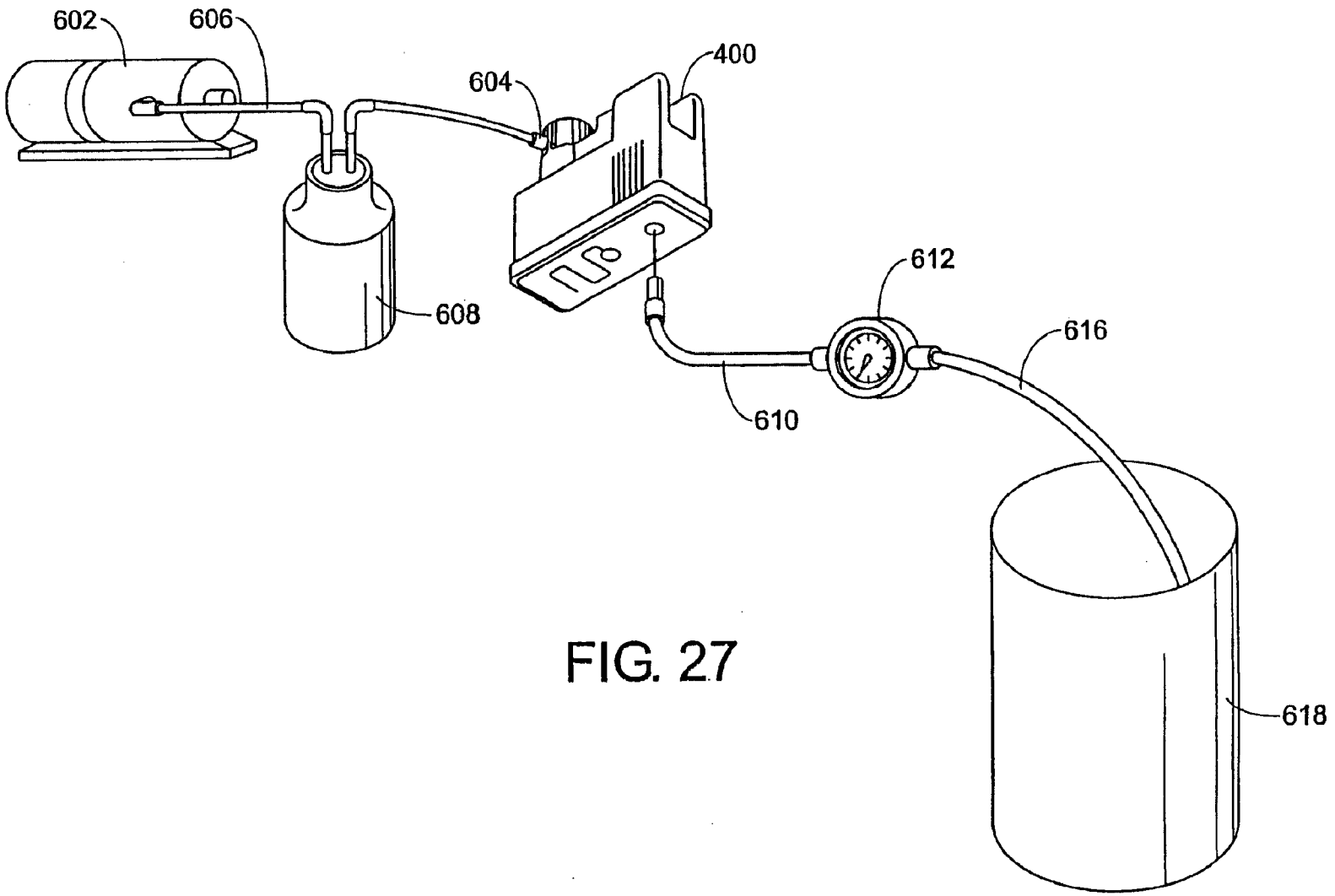
FIG. 27 is a perspective view of still another embodiment of the ink filling device filled under negative pressure.

As shown in the FIG. 27, the ink cartridge 400 is placed with the ink supply port upside down. The ink container 618 is connected to the ink cartridge 400 by a tube 616 in a sealed state. There is an ink flow control device 612 in the middle of the tube 616 for controlling the amounts. In the hole 470 of the ink cartridge 400, the needle with a tube 606 sticks into the rubber stopper 472 and connects the tube and the ink guide chamber 412 of the ink cartridge. The other end of the tube connects to an air pump 602. There is an air and liquid separator 608 connected to the tube 606. When air in the ink chamber 412 of the ink cartridge 400 is withdrawn and the difference of pressure between the opposite side of the valve is changed, the valve is open and the air of the chamber 402 also is withdrawn and the ink flows into the chamber 402. The ink cartridge 400 is placed upside down, which lets the ink of the chamber 402 flow in quickly and fill the ink guide chamber. When the ink reaches a predetermined volume, filling is stopped. In practice, the ink cartridge may be put in a side face and the process is the same.

As shown in FIG. 7A, when the large diameter of the valve 30 is less than 11 millimeters and the volume of air trapped in the ink guide chamber 412 is less than 0.4 cubic millimeters, it is unnecessary to fill ink in the ink guide chamber 412. Air trapped in the ink guide chamber must be drawn out, for example, by the cleaning operation of the printer. The remainder of the ink cartridge can be filled under normal atmospheric pressure or under a pressure sufficiently low relative to atmospheric pressure.

Under the circumstances of negative pressure, the pressure of the small cavity under the valve 30 is −700 mPa to −750 mPa, while the pressure above the valve is increasing as the amount of ink increases in the ink tank. When a predetermined value is reached, the valve 30 opens and allows ink flows to the lower part of the tank. The volume of the lower part of the valve is so small that it can be filled almost at the same time the valve 30 is opened. Then the valve closes by its elastic nature and the upper part fills fully until the filling process is finished.

Figure 28:
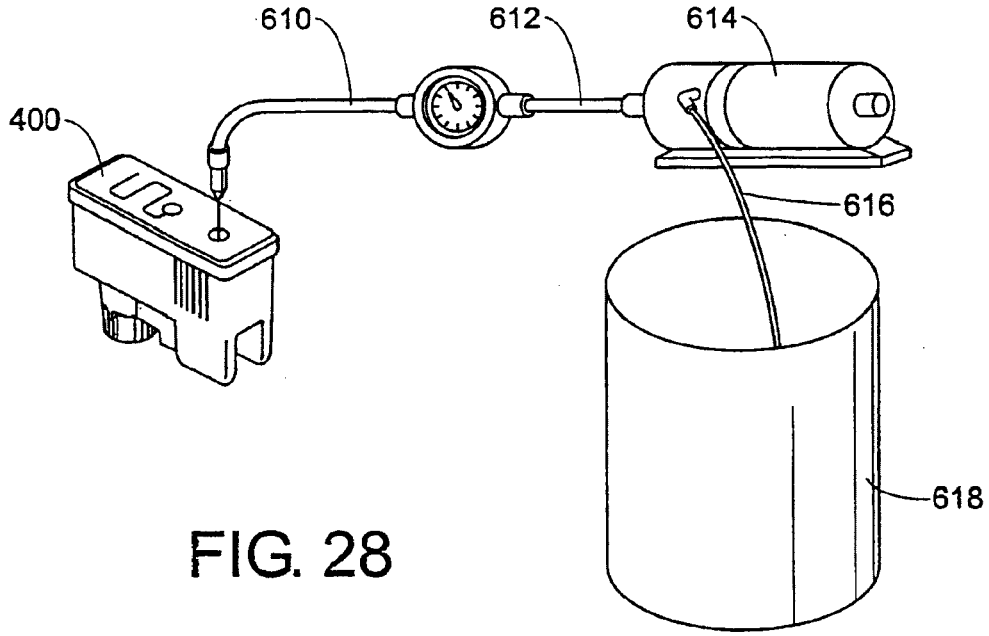
FIG. 28 is a perspective view of the ink-filling device according to a further embodiment of the present invention filled under positive pressure.

As shown in FIG. 28, the maximum diameter of supporting foot is 9 mm and there is no need to preserve the ink and to locate the hole in the wall of the outlet but there is a need to locate the filling hole in the cover of the cartridge. There is also no need to withdraw air in the process. The vessel 618 connects to one side of the liquid pump 614 by a tube 616; and the other side connects to the hole of the ink cartridge 400 by an ink tube 610. There is an ink flow control device 612 in the middle of the tube 610 for controlling amounts of ink. In filling ink, the ink flows from the ink filling hole 440 to the ink chamber 402 directly and destroying the meniscus of the ink formed in the ink filling hole 440 by positive pressure.

Figure 29:
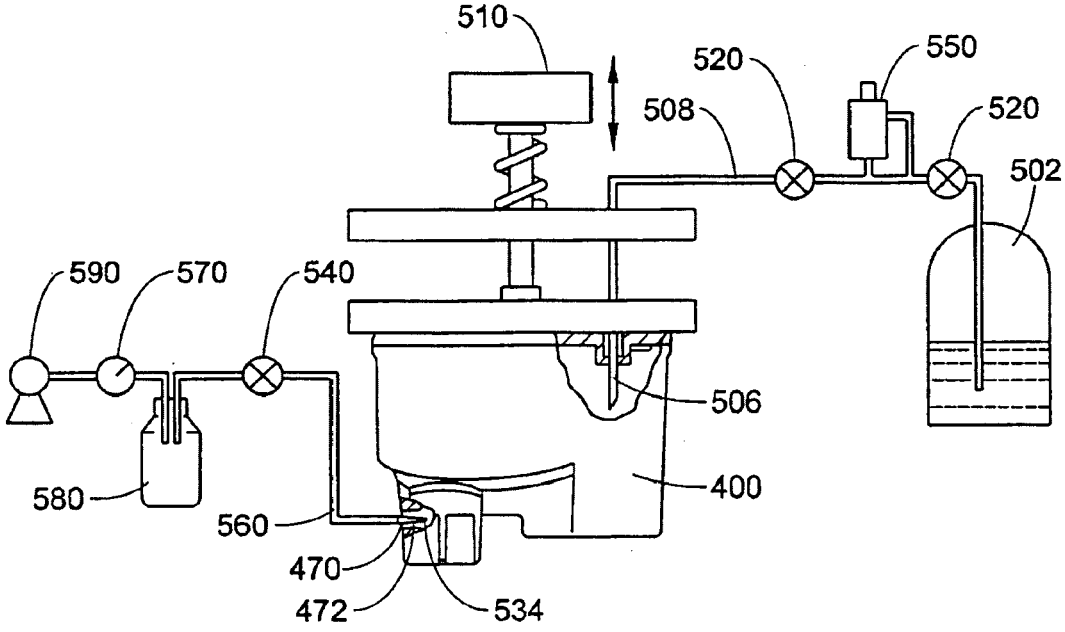
FIG. 29 is a perspective view of the ink-filling device of the present invention filled under negative pressure.

Negative pressure could also be used for filling ink in the ink cartridge of the invention as can be see in the FIG. 16E and FIG. 29. When filling ink, first the assembled ink cartridge 400 is inserted upright or on its side and the needle 506 is inserted into the ink filling hole 440 of the cover 410 of cartridge. The other end of the needle 506 connects to a tube 508 which connects to the vessel of ink supply container 502. The level of the vessel of ink supply container 502 is higher than the level of the ink cartridge 400. An air hole 470 in the wall of the outlet 404 is plugged by the stopper 472. The air needle 560 sticks to the stopper 472 at one end and connects to the air-liquid separator 580 by an electromagnetic valve 540. The air and liquid separator 580 connects to the vacuum pump 590 by the ink flow control device 570. When filling, the pressure device 510 seals the cover of the cartridge 400 and the switch of the vacuum pump 590 is turned on at the same time. When the vacuum pump 590 is operating, electromagnetic valve 540 is open and electromagnetic valve 520 is closed and the air of the lower part of the valve 30 is withdrawn out. The valve 30 is opened in response to the pressure difference ,and as a result the air in the upper part of the valve 30 is withdrawn out too. At that time the air of the balloon chamber 456 is withdrawn as there is a hole 454 in the wall of balloon 450. When the vacuum meter 570 is −700 to −750 mPa, electromagnetic valve 540 is closed and electromagnetic valve 520 and electromagnetic valve 530 are open. There is negative pressure in the ink cartridge and the ink is withdrawn from the ink supply container 502 to the tank of the ink cartridge. As the amount of the ink increases in the ink cartridge, the pressure of the upper part of the valve increases to a certain value, while the pressure of the ink guide chamber is still negative (around 700 to 750 mPa), and the valve 30 opens and allows ink flow to the ink guide chamber. The lower part of the valve can be filled almost at the same time as valve 30 opens. Then the valve closes by its elastic capability and the upper part completely fills and the filling process is finished.

According to the invention, the vacuum meter 570 connects to the vacuum pump 590 in one side and to the electromagnetic valve 540 in the other. When the vacuum meter 570 is at the negative 700 to 750 mPa level, electromagnetic valve 540 is closed and separates the air needle 534 from the stopper 472 of the air hole 470.

The invention has been described with reference to the preferred embodiments. Obviously, modification and alterations will occur to others upon a reading and understanding of the present application. It is intended to include such modifications and alterations.

What is claimed is:

1. An ink cartridge for an ink jet recording apparatus, comprising:

a cartridge body for accommodating ink with at least one ink chamber, wherein said cartridge body comprising:

at least an air vent for providing fluid communication between said ink chamber and outside air;

at least an ink outlet port for supplying the ink from said ink chamber;

at least a sealing member provided within said ink outlet port for sealing said ink outlet port;

at least a one-way valve disposed within said ink chamber for controlling ink flow, wherein said at least one-way valve is integrally provided with:

a foot support portion sealing an interior wall of said ink outlet port;

a wall support portion projecting from the interior of said foot support portion;

a shoulder support portion bending toward interior of said wall support portion;

a head support portion projecting from said shoulder support portion with a through hole; and at least a valve sealing assembly being maintained selectively in contact with said head support portion through hole by a pressure difference.

2. An ink cartridge according to claim 1, wherein said wall support portion projects at an angle from said foot support portion.

3. An ink cartridge according to claim 1, wherein said shoulder support portion is provided with a recess formed by said wall support portion bending inwardly.

4. An ink cartridge according to claim 1, wherein said head support portion projects at an angle from said shoulder support portion.

5. An ink cartridge according to claim 4 wherein the sloping angle of said head support portion is dimensioned to be greater than that of said wall support portion.

6. An ink cartridge according to claim 1 wherein said through hole of said head support portion is cone-shaped.

7. An ink cartridge according to claim 1, wherein the thickness of said foot support portion is dimensioned to be greater than that of said head support portion and the thickness of said head support portion is dimensioned to be greater that of said shoulder support portion.

8. An ink cartridge according to claim 1 wherein a recess is formed by an interior wall of said ink outlet port for receipt of said valve.

9. An ink cartridge according to claim 8, wherein said recess further including a stepped circular region defined by the bottom wall of said recess for receipt of a filter member.

10. An ink cartridge according to claim 1, wherein said head support portion of said one-way valve is in a slightly compressed contact with said valve sealing assembly in non working status.

11. An ink cartridge according to claim 1, wherein an ink leakage preventing device is disposed at said air vent to prevent ink leaking from said air vent.

12. An ink cartridge according to claim 11, wherein said ink leakage preventing device is a protrusion protruded from said air vent to said ink chamber.

13. An ink cartridge according to claim 11, wherein said ink leakage preventing device is a bending tube surrounding the periphery of said air vent, with one end connecting to said air vent and the other coming out of the ink.

14. Art ink cartridge according to claim 11, wherein said ink leakage preventing device is a bag-shaped member disposed within said ink chamber, comprising:

an open end, for connecting to said air vent; and a tiny hole, provided in a wall of said bag-shaped member.

15. An ink cartridge according to claim 14, wherein said bag-shaped member is an elastic balloon with an open end.

16. An ink cartridge according to claim 15, wherein a bowl-shaped cap for fixing said elastic balloon, comprising:

an opening therethrough, said opening having a wide end dimensioned to engage with the outer periphery of said protrusion of said air vent and a narrow end acting as an elongated part of said air vent; and a shoulder for mounting said open end of said elastic balloon.

17. An ink cartridge according to claim 14, wherein a projection is provided on the bottom wall of said ink chamber to fix said bag-shaped member.

18. An ink cartridge according to claim 14, wherein said open end of said bag-shaped member has an opening substantially equal to said wall of cartridge body on which said air vent is provided within.

19. An ink cartridge according to claim 18, wherein said bag-shaped member has several overlapped layers.

20. An ink cartridge according to claim 1 wherein the bottom wall of said ink chamber slopes to said ink outlet port.

21. An ink cartridge according to claim 1, wherein at least an ink guide groove is formed in the surface of the bottom wall of said ink chamber.

22. An ink cartridge according to claim 1, wherein said air vent communicates with the outside via the irregular air-guided vent formed in said wall of said cartridge body.

23. An ink cartridge according to claim 22, wherein part of said air-guided vent is disposed at the interior surface of said wall.

24. An ink cartridge according to claim 22 wherein an air guide film is provided on the outside surface of said wail on which said air vent is provided.

25. An ink cartridge according to claim 1, wherein an ink filling hole is provided on a wall of said cartridge body and is sealed by a seal plug.

26. An ink cartridge according to claim 1, wherein said sealing assembly provided within said ink outlet, comprising:

a support portion integrally formed with a chamber inside, supported by the interior wall of said ink outlet port;

a sealing portion projecting from said support portion;

a block portion corresponding to said seal portion; and a connection portion surrounding between said seal portion and said block portion to support said block portion being separated from said connection portion upon a certain pressure.

27. An ink cartridge according to claim 26, wherein a tapered surface is provided inwardly of said sealing assembly.

28. An ink cartridge according to claim 26, wherein a circle-shaped groove of the sealing assembly facilitates separation of said block portion from said sealing assembly.

29. An ink cartridge according to claim 26, wherein the thickness of said connection portion is different.

30. An ink cartridge according to claim 29, wherein the thickness of said connection portion decreases from one side to the other.

31. An ink cartridge according to claim 1, wherein an off-gas vent is provided on said wall of said ink outlet port.

* * * * *